US010986968B2

(12) United States Patent
Kasper

(10) Patent No.: US 10,986,968 B2
(45) Date of Patent: Apr. 27, 2021

(54) VACUUM CLEANER

(71) Applicant: BISSELL Homecare, Inc., Grand Rapids, MI (US)

(72) Inventor: Gary A. Kasper, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 347 days.

(21) Appl. No.: 15/212,700

(22) Filed: Jul. 18, 2016

(65) Prior Publication Data

US 2016/0324381 A1 Nov. 10, 2016

Related U.S. Application Data

(63) Continuation of application No. 13/938,317, filed on Jul. 10, 2013, now Pat. No. 9,392,919.

(60) Provisional application No. 61/671,252, filed on Jul. 13, 2012.

(51) Int. Cl.

| | |
|---|---|
| ***A47L 5/22*** | (2006.01) |
| ***A47L 9/24*** | (2006.01) |
| ***A47L 9/16*** | (2006.01) |
| ***A47L 9/28*** | (2006.01) |
| ***A47L 9/32*** | (2006.01) |
| ***A47L 5/30*** | (2006.01) |
| ***A47L 9/04*** | (2006.01) |

(52) U.S. Cl.

CPC ..... *A47L 5/225* (2013.01); *A47L 5/30* (2013.01); *A47L 9/0411* (2013.01); *A47L 9/0466* (2013.01); *A47L 9/0483* (2013.01); *A47L 9/16* (2013.01); *A47L 9/165* (2013.01); *A47L 9/1641* (2013.01); *A47L 9/1658* (2013.01); *A47L 9/1683* (2013.01); *A47L 9/24* (2013.01); *A47L 9/248* (2013.01); *A47L 9/2857* (2013.01); *A47L 9/325* (2013.01)

(58) Field of Classification Search

CPC ... A47L 5/225; A47L 9/32; A47L 9/24; A47L 9/248

See application file for complete search history.

(56) References Cited

U.S. PATENT DOCUMENTS

| | | | | |
|---|---|---|---|---|
| 3,969,096 A | | 7/1976 | Richard | |
| 4,571,772 A | | 2/1986 | Dyson | |
| 4,660,246 A | * | 4/1987 | Duncan | A47L 9/32 15/329 |
| 4,853,008 A | | 8/1989 | Dyson | |
| 5,230,722 A | | 7/1993 | Yonkers | |

(Continued)

FOREIGN PATENT DOCUMENTS

| | | |
|---|---|---|
| EP | 0923992 A2 | 6/1999 |
| EP | 2471429 A2 | 7/2012 |

(Continued)

*Primary Examiner* — Bryan R Muller

(74) *Attorney, Agent, or Firm* — McGarry Bair PC

(57) ABSTRACT

A vacuum cleaner includes an upright handle assembly, a foot assembly adapted to be moved along a surface to be cleaned and having a suction nozzle, a multi-axis joint swivelably mounting the upright handle assembly to the foot assembly and defining a first axis about which the upright handle assembly twists relative to the foot assembly and a second axis about which the upright handle assembly pivot relative to the foot assembly, and a detachable vacuum module supported on the upright handle assembly by the module platform.

18 Claims, 16 Drawing Sheets

(56) References Cited

U.S. PATENT DOCUMENTS 5,267,371 A 12/1993 Soler et al.
5,309,600 A 5/1994 Weaver et al.
5,524,321 A * 6/1996 Weaver ..... A47L 5/225 15/323
5,715,566 A 2/1998 Weaver et al.
6,094,775 A 8/2000 Behmer
6,345,408 B1 * 2/2002 Nagai ..... A47L 9/02 15/361
6,374,453 B1 * 4/2002 Kim ..... A47L 5/225 15/328
6,428,589 B1 8/2002 Bair et al.
6,578,230 B2 6/2003 Park et al.
6,607,572 B2 8/2003 Gammack et al.
6,766,557 B2 7/2004 Park et al.
6,829,804 B2 12/2004 Sepke
6,896,719 B2 5/2005 Coates et al.
6,961,975 B2 11/2005 Park et al.
6,994,740 B2 2/2006 Gammack et al.
7,065,826 B1 6/2006 Arnold
7,162,770 B2 1/2007 Davidshofer
7,247,181 B2 7/2007 Hansen et al.
7,297,172 B2 11/2007 Lee
7,360,274 B2 4/2008 Park et al.
7,361,200 B2 4/2008 Oh et al.
7,377,007 B2 5/2008 Best
7,377,008 B2 5/2008 Park et al.
7,395,579 B2 7/2008 Oh
7,517,377 B2 4/2009 Yoshida et al.
7,600,291 B2 10/2009 Choi
7,662,201 B2 2/2010 Lee
7,780,753 B2 8/2010 Lang
7,857,878 B2 12/2010 Park et al.
7,951,218 B2 5/2011 Oh
7,996,956 B2 8/2011 Wood et al.
8,869,348 B2 10/2014 Conrad
9,107,558 B2 8/2015 Lenkiewicz et al.
9,138,114 B2 * 9/2015 Conrad ..... A47L 5/225
2006/0207054 A1 * 9/2006 Loebig ..... A47L 5/28 15/351
2006/0213024 A1 9/2006 Lee et al.
2007/0039292 A1 2/2007 Oh et al.
2007/0079586 A1 4/2007 Kim
2007/0234687 A1 10/2007 Ni
2009/0056059 A1 * 3/2009 Mersmann ..... A47L 5/28 15/347
2009/0133370 A1 5/2009 Yoo et al.
2009/0282791 A1 11/2009 Lang
2011/0023256 A1 * 2/2011 Conrad ..... A47L 5/225 15/300.1
2011/0107553 A1 * 5/2011 Myers ..... A47L 5/28 15/411
2012/0060322 A1 * 3/2012 Simonelli ..... A47L 9/009 15/411
2012/0079679 A1 * 4/2012 Seo ..... A47L 9/009 15/415.1

FOREIGN PATENT DOCUMENTS

GB 2375980 A 12/2002
JP H08322769 A 12/1996
WO 2002069778 A1 12/2002

* cited by examiner

10

VACUUM CLEANER

CROSS-REFERENCE TO RELATED APPLICATIONS

This application is a continuation of U.S. patent application Ser. No. 13/938,317, filed Jul. 10, 2013, now U.S. Pat. No. 9,392,919, which claims the benefit of U.S. Provisional Patent Application No. 61/671,252, filed Jul. 13, 2012, both of which are incorporated herein by reference in their entirety.

BACKGROUND OF THE INVENTION

Vacuum cleaners can employ a variety of dirt separators to remove dirt and debris from a working air stream. Some vacuum cleaners employ cyclone separators. Cyclone separators can comprise one or more frusto-conical shaped separators, or use high-speed rotational motion of the air/dirt to separate the dirt by centrifugal force. Some cyclone separators can include more than one separator arranged in series or parallel to provide a plurality of separation stages. Typically, working air enters an upper portion of the cyclone separator through a tangential inlet and dirt is collected in the bottom portion of the cyclone separator. The filtered working air can exit through an upper portion of the cyclone separator or through a lower portion of the cyclone separator via an exhaust pipe. Prior to exiting the cyclone separator, however, the working air may flow through an exhaust grill. The exhaust grill can employ perforations, holes, inlet vanes, or louvers that define inlet openings through which filtered working air may pass. The filtered working air may pass through the inlet openings in the grill into one or more downstream cyclonic separators and/or a fluidly connected exhaust duct and interconnected air path to a downstream a suction source.

BRIEF SUMMARY OF THE INVENTION

According to one embodiment of the invention, an upright vacuum cleaner includes an upright handle assembly, a foot assembly adapted to be moved along a surface to be cleaned and having a suction nozzle, a multi-axis joint swivelably mounting the upright handle assembly to the foot assembly and defining a first axis about which the upright handle assembly twists relative to the foot assembly and a second axis about which the upright handle assembly pivot relative to the foot assembly, and a detachable vacuum module supported on the upright handle assembly by the module platform. The vacuum module can include a module housing, a working air path through the module housing and having an air inlet and an air outlet, a dirt separator defining a portion of the working air path and comprising a separator inlet in fluid communication with the air inlet, and a motor/fan assembly fluidly upstream of the air outlet and defining a portion of the working air path. The vacuum module is adapted to be operated independently from the upright handle assembly and the foot assembly, or mounted on and operated in conjunction with the upright handle assembly and foot assembly.

DESCRIPTION OF EMBODIMENTS OF THE INVENTION

The invention relates to vacuum cleaners and in particular to vacuum cleaners having cyclonic dirt separation. In one of its aspects, the invention relates to an improved exhaust grill for a cyclone module assembly. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
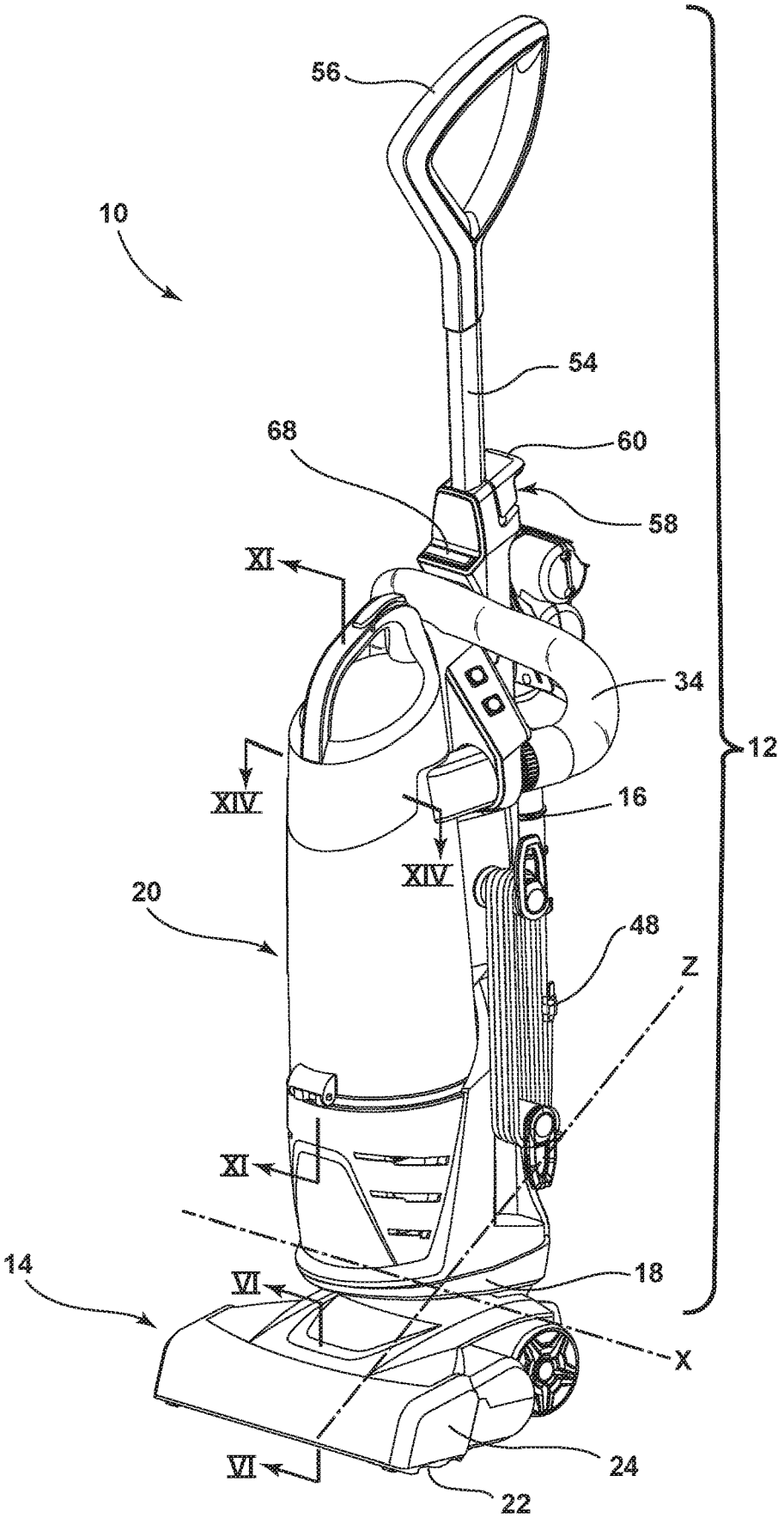
FIG. 1 is a front perspective view of a vacuum cleaner according to a first embodiment of the invention, shown with a handle tube in an extended position.

Referring to the drawings and in particular to FIG. 1, an upright vacuum cleaner 10 according to the invention comprises an upright handle assembly 12 pivotally mounted to a foot assembly 14. The upright handle assembly 12 further comprises an elongated structural support 16 connected to a module platform 18, which is adapted to support a detachable cyclonic vacuum module 20 that can be operated independently from the upright handle assembly 12 and the foot assembly 14, or mounted on and operated in conjunction with the upright handle assembly 12 and foot assembly 14.

Figure 6:
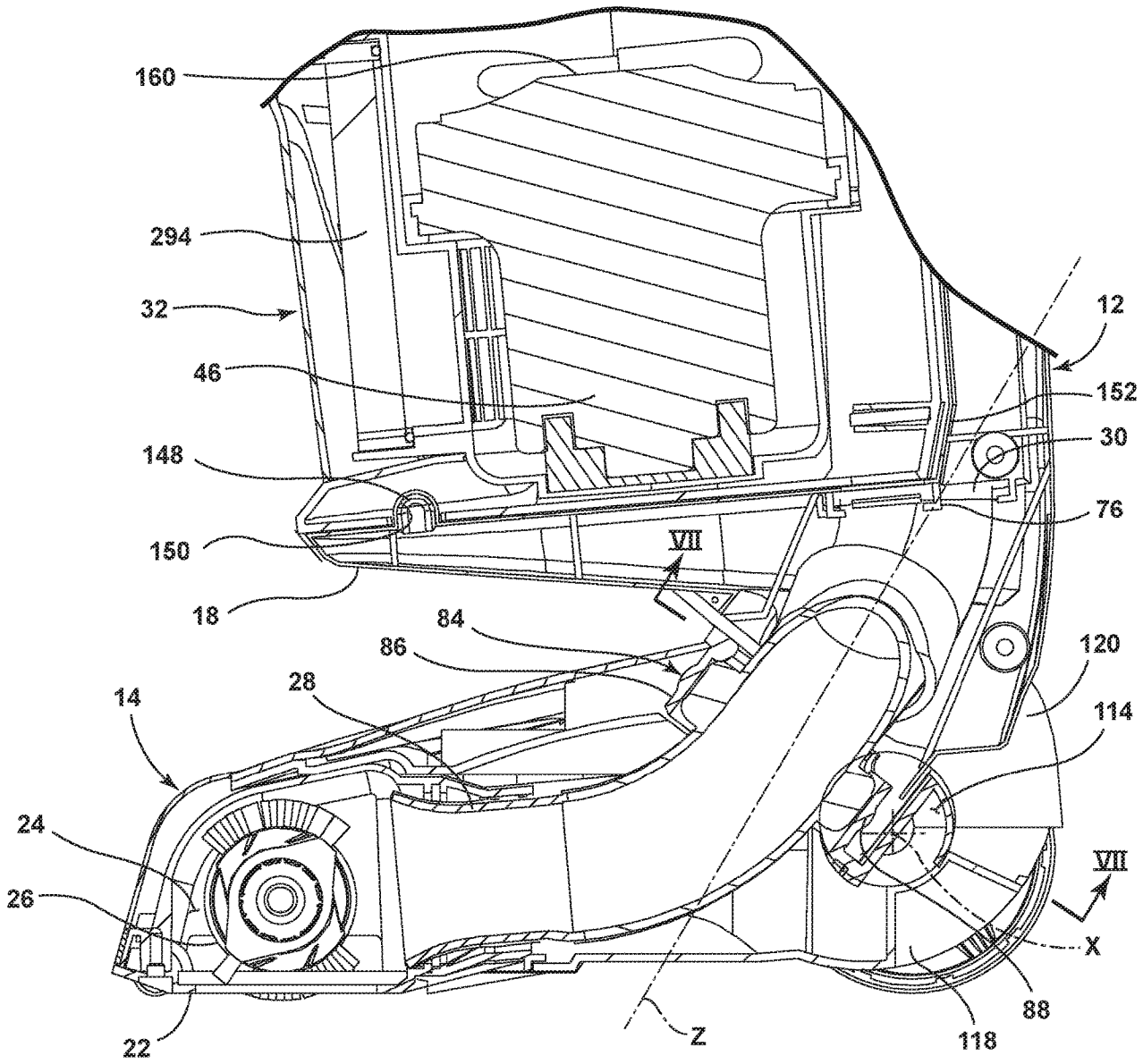
FIG. 6 is a partial cross-sectional view of the foot and multi-axis joint of the vacuum cleaner of FIG. 1, taken along line VI-VI of FIG. 1.

Referring to FIG. 6, a portion of a working air path through the vacuum cleaner 10 comprises a suction nozzle inlet opening 22 defined by the lower portion of an agitator chamber 24, which houses a rotatably mounted agitator 26 therein for agitating the surface to be cleaned. Alternatively, the vacuum cleaner 10 can be provided with another type of agitator, such as a stationary agitator, dual rotating agitators, an oscillating agitator, or at least one agitator that is rotatably mounted about a vertical axis. A first end of a flexible conduit 28 is fluidly connected to the agitator chamber 24. The flexible conduit 28 is routed through the foot assembly 14 and lower portion of the handle assembly 12 and terminates at a second end that is fluidly connected to an air conduit interface 30 on the top surface of the module platform 18.

Figure 2:
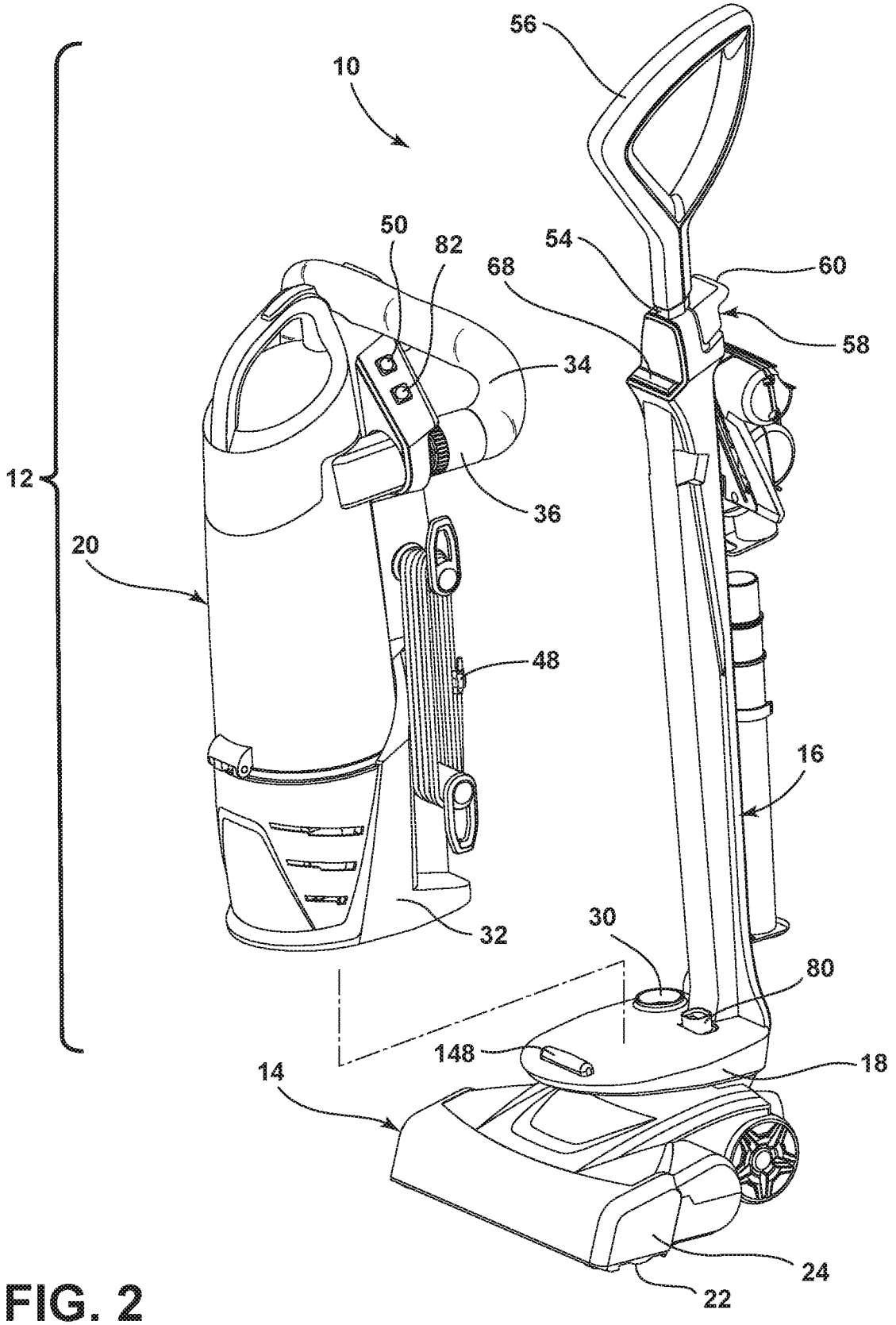
FIG. 2 is a front perspective view of the vacuum cleaner of FIG. 1, with a cyclonic vacuum module of the vacuum cleaner shown in a detached position and with the handle tube in a retracted position.
Figure 3:
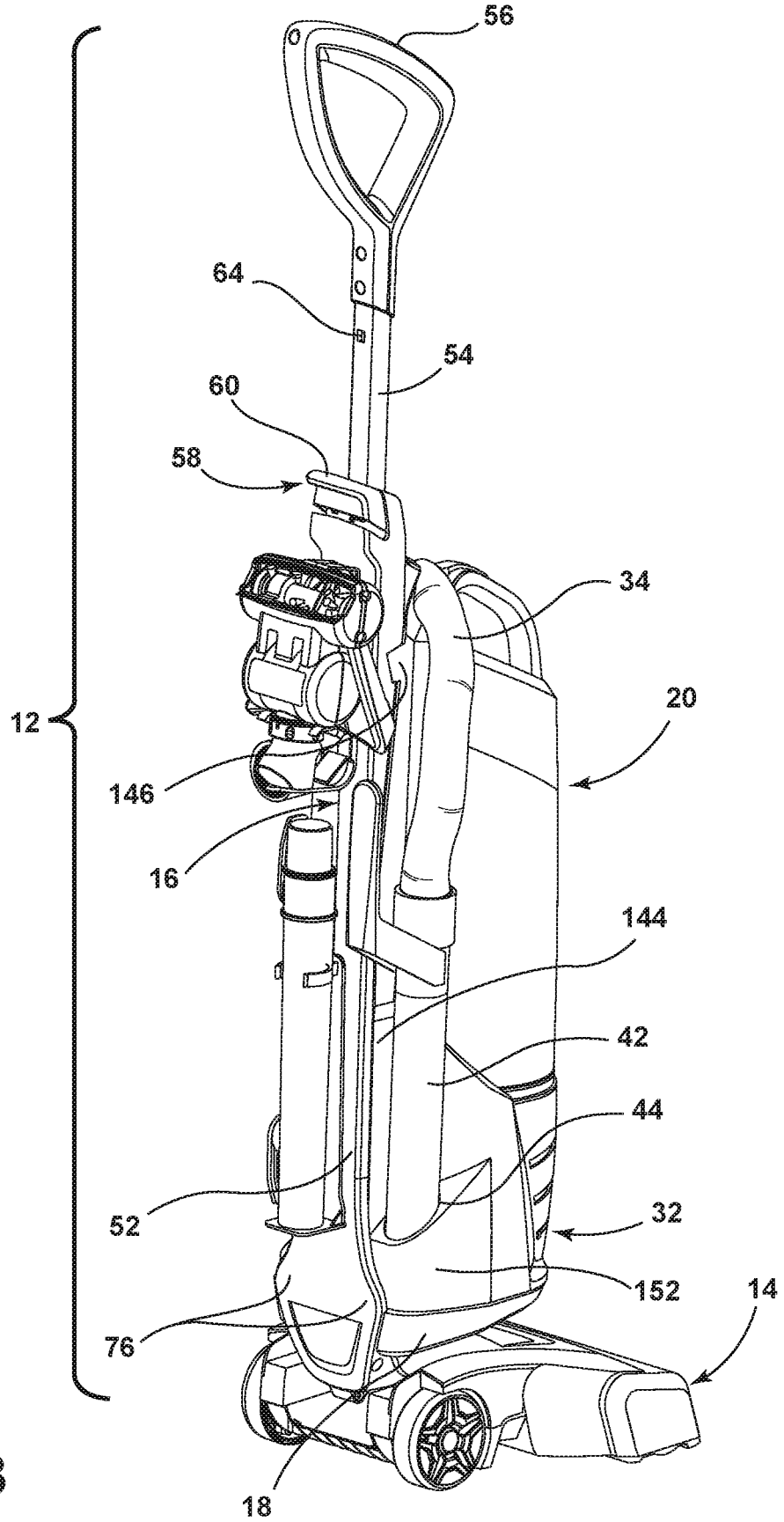
FIG. 3 is a rear perspective view of the vacuum cleaner of FIG. 1, shown with the handle tube in the extended position.
Figure 4:
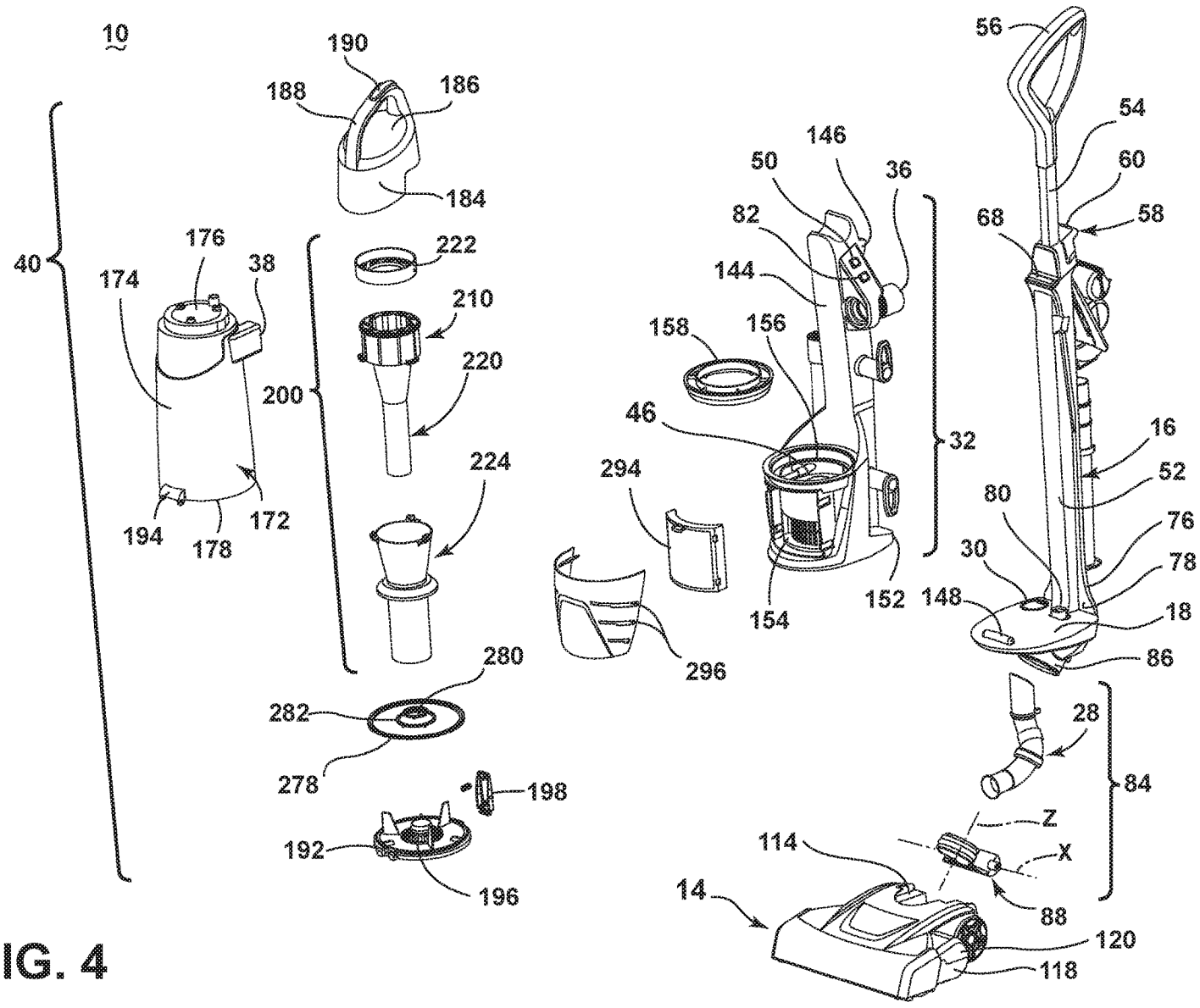
FIG. 4 is a partial exploded view of the vacuum cleaner of FIG. 1.

Referring to FIG. 2-4, the detachable vacuum module 20 comprises a module housing 32 adapted to be partially supported by the elongated structural support 16 and the module platform 18, the housing 32 including a flexible suction hose 34 having a first end connected to a hose outlet conduit 36 that is adapted for fluid connection with a tangential inlet 38 on a dirt separator and collection module 40. The opposite end of the suction hose 34 comprises a wand or hose inlet 42 that can be selectively inserted into a hose inlet conduit 44 on the module housing 32, which fluidly connects the hose inlet 42 to the air conduit interface 30 when the vacuum module 20 is mounted on the module platform 18. The vacuum module 20 further comprises a suction source mounted in the module housing 32 that can comprise a motor/fan assembly 46 adapted to draw a working air flow stream through the working air path. The vacuum module 20 can include a power cord 48 interconnected to at least one power switch 50 for delivering power to the motor/fan assembly 46 and any other associated electrical components, mounted within the vacuum module 20, handle 12 or foot assembly 14.

As shown in FIG. 2, the vacuum module 20 is detachable and can be used independently from the upright handle assembly 12 and foot assembly 14, such that a working air flow can be drawn through the hose inlet 42, through the flexible suction hose 34 into the dirt separator and collection module 40 and through the downstream motor/fan assembly 46. Alternatively, the vacuum module 20 can be mounted onto the upright handle assembly 12 and module platform 18 so that the hose inlet conduit 44 is fluidly connected to the air conduit interface 30 and a working air flow stream can be drawn through the suction nozzle inlet 22, flexible conduit 28, suction hose 34, dirt separator and collection module 40 and downstream motor/fan assembly 46.

Referring to FIG. 3, the elongated structural support 16 is defined by a hollow tubular spine member 52 that is configured to slidably receive a telescoping handle tube 54 therein. The telescoping handle tube 54 is connected to grip 56 at an upper end and a selectively engageable handle locking mechanism 58 at a lower end. For exemplary purposes, the handle locking mechanism 58 is illustrated as a spring loaded button 60 slidably mounted on the spine member 52 that is configured to engage a biased latch (not shown) pivotally mounted in the back of the vacuum module housing 32. The upper handle tube 54 comprises a plurality of detents 64, illustrated as recessed depressions, for adjusting the upper handle tube 54 to a fully extended position shown in FIGS. 1 and 3, a fully retracted position shown in FIG. 2 or various intermediate positions therebetween (not shown).

Referring to FIG. 4, the elongated structural support 16 further comprises a vacuum module locking mechanism that is configured to selectively retain an upper portion of the vacuum module 20 to the front of the spine member 52. The vacuum module locking mechanism can comprise any suitable retention mechanism but has been illustrated for exemplary purposes as a spring loaded button latch 68 that is slidably mounted at the front of the spine member 52 and is adapted to selectively engage a corresponding spring-loaded catch (not shown) on the vacuum module housing 32. The catch includes hooks (not shown) that are configured to engage corresponding slots (not shown) on the spine member 52. The button latch 68 can be selectively depressed to engage the catch, which releases the hooks from the corresponding slots on the spine member 52 so the vacuum module 20 can be freely removed from the upright handle assembly 12.

The module platform 18 is rigidly attached to the elongated structural support 16. A brace 76 on the back of the spine member 52 connects the lower rear portion of the spine member 52 to the back of the module platform 18 and strengthens the junction of the module platform 18 and the elongated structural support 16 to increase the structural rigidity. In addition, the brace 76 defines a front stopping surface 78 that is adapted to guide and support a lower portion of the vacuum module 20 during installation and use. In addition to the air conduit interface 30, an electrical connector 80 is mounted on the top of the module platform 18 and is operably connected to electrical components within the foot assembly 14 such as an agitator drive motor (not shown). The electrical connector 80 is adapted for selective connection to a mating connector (not shown) that is mounted to the bottom of the vacuum module 20 and which is operably connected to the motor/fan assembly 46, power cord 48, power switch 50, and brush motor control switch 82. When the vacuum module 20 is mounted to the module platform 18 and the two connectors are electrically engaged, power can be delivered to the electrical components mounted in the vacuum module 20, foot assembly 14, or handle assembly 12, for example.

Figure 5:
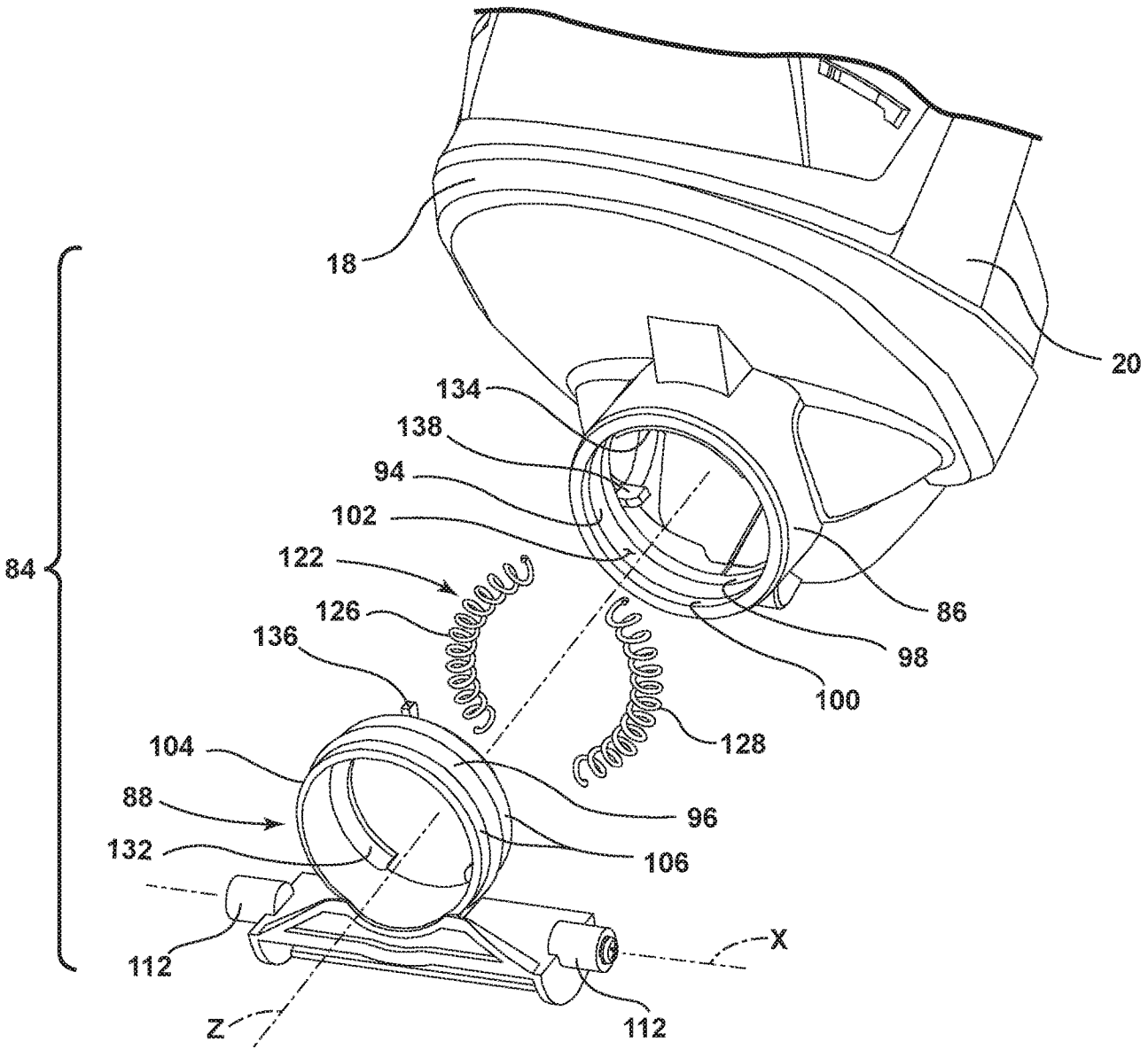
FIG. 5 is a partial exploded view of a multi-axis joint of the vacuum cleaner of FIG. 1

A multi-axis joint 84 is mounted to the bottom of the module platform 18 and is configured to rotate the upright handle assembly 12 about two different axes relative to the foot assembly 14. As best shown in FIGS. 4 and 5, the joint 84 comprises a pivot neck 86 that extends downwardly at an angle from the module platform 18 and a pivot ring 88 that is configured to be rotatably mounted within the distal end of the pivot neck 86. The joint 84 is configured to permit the upright handle assembly 12 to twist relative to the foot assembly 14 about a first axis Z and pivot relative to the foot assembly 14 about a second axis X. Twisting the upright handle assembly 12 about the first axis Z can change the angle between the upright handle assembly 12 and the foot assembly 14 relative to the surface to be cleaned, which can facilitate turning the vacuum cleaner 10 left or right. Pivoting the upright handle assembly 12 about the second axis X allows the upright handle assembly 12 to be moved forward and backward with respect to the foot assembly 14, between an upright storage position and a reclined use position. The first axis Z may be at an angle to the surface to be cleaned, while the second axis X may be generally horizontal or parallel to the surface to be cleaned.

Referring to FIG. 5, the pivot neck 86 comprises a cylindrical portion, which defines the first axis Z. An annular bearing channel 94 within the lower end of the pivot neck 86 is configured to rotatably receive a corresponding annular bearing protrusion 96 on the outer surface of the pivot ring 88. The bearing channel 94 is defined by an upper annular undulation 98 and a lower annular undulation 100. Accordingly, bearing channel 94 can comprise a bearing surface 102 that is partially formed by the upper annular projection 98 and lower annular projection 100.

The pivot ring 88 comprises a ring-shaped member with an outer bearing surface 104 comprising the annular bearing protrusion 96. The bearing protrusion 96 is configured to nest within the bearing channel 94 in sliding register between the upper annular projection 98 and lower annular projection 100. The annular projections restrict axial movement of the pivot ring 88 along the first axis Z, while permitting the pivot ring 88 to rotate about the first axis Z. The pivot ring 88 further comprises an upper surface 106 and lower surface 106 at the top and bottom, adjacent the bearing protrusion 96. The upper surface and lower surface 106 slidingly abut the outer surface of the upper annular projection 98 and lower annular projection 100 and thereby further restrict axial movement of the pivot ring 88 along the first axis Z.

The pivot ring 88 further comprises opposed, coaxial pivot bosses 112 that protrude outwardly from a rear portion of the pivot ring 88. The pivot bosses 112 define the second axis X. The pivot bosses 112 are pivotally received within bearings 114 in the foot assembly 14 (FIG. 4), which are formed by mating cradle ribs 116 in a base housing 118 and top cover housing 120 (FIG. 7).

The upright handle assembly 12 is swivelably mounted to the foot assembly 14 via the joint 84, which is configured to rotate the upright handle assembly 12 about both of the X and Z axes, relative to the foot assembly 14. The upright handle assembly 12, including the module platform 18 is adapted to pivot about the second axis X. A user can recline the handle 12 by pulling the grip 56 rearwardly, which rotates the entire upright handle assembly 12 about the second axis X, on the pivot bosses 112 that are rotatably received within the associated bearings 114. Furthermore, the upright handle assembly 12 is adapted to twist about the first axis Z on the pivot neck 86, which is configured to rotate around the pivot ring 88. A user can twist the grip 56 relative to the first axis Z to change the rotational orientation of the upright handle assembly 12 relative to the foot assembly 14. The rotational force is transmitted from the grip 56 through the elongated structural support 16 and module platform 18 to the pivot neck 86 associated therewith. The bearing channel 94 and bearing surface 102 can rotate about the first axis Z and slide relative to the bearing protrusion 96 and outer bearing surface 104 of the pivot ring 88, thus twisting the upright handle assembly 12 relative to the foot assembly 14 about the first axis Z, which can also articulate the foot assembly 14 relative to the handle assembly 12 to maneuver the vacuum cleaner 10 across the surface to be cleaned.

Figure 7:
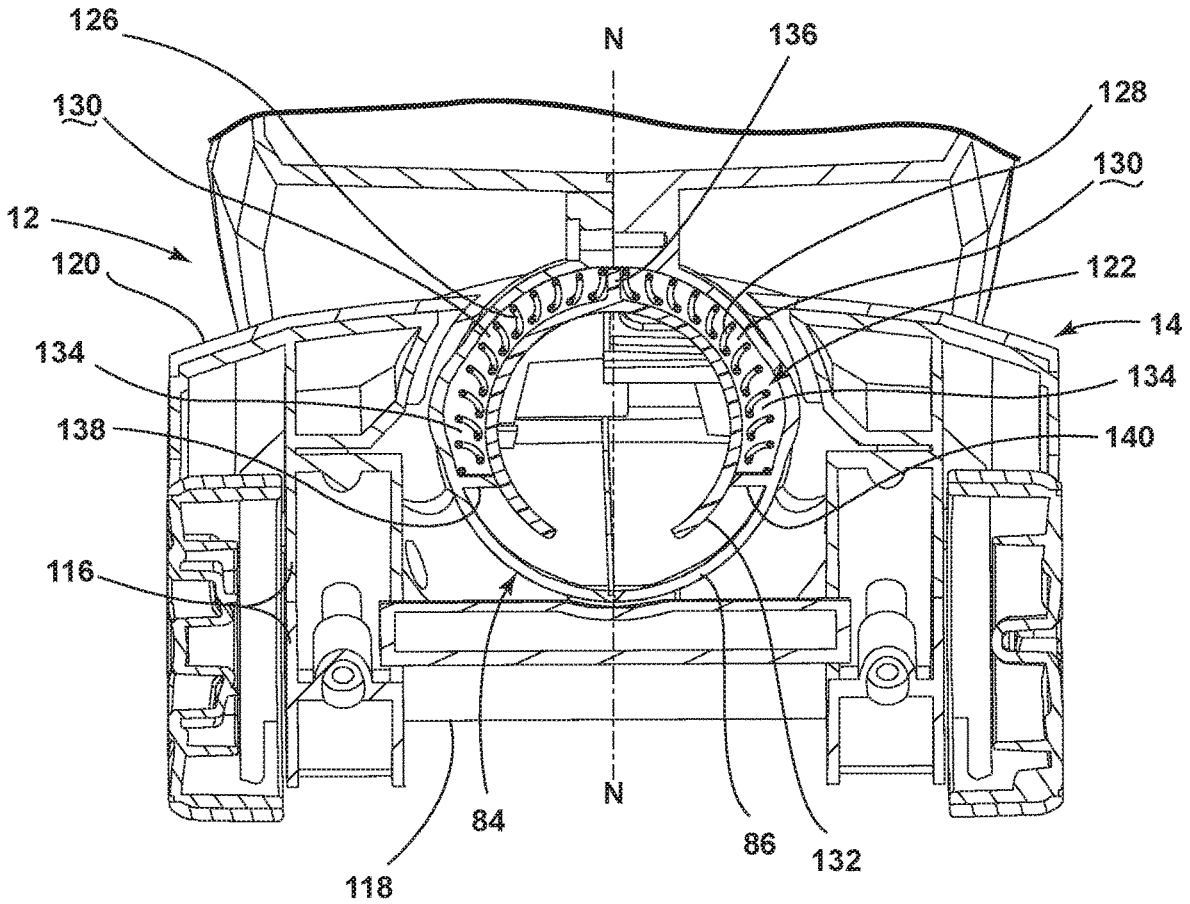
FIG. 7 is a partial cross-sectional view of the multi-axis joint taken along line VII-VII of FIG. 6.

As best seen in FIGS. 5 and 7, the joint 84 can comprise a biasing mechanism 122, which can be configured to bias the handle assembly 12 about the first axis Z towards a neutral position, "N" lying along a vertical plane through the front-to-rear center line of the pivot ring 88. The neutral position N is shown in FIGS. 1 and 7, and in solid line in FIG. 8.

The biasing mechanism 122 as illustrated comprises a right coil spring 126 mounted along the right side of the joint 84, from the perspective of a user behind the vacuum cleaner, and a left coil spring 128 mounted along the left side of the joint 84. Both coil springs 126, 128 are mounted between the pivot ring 88 and the inner surface of the pivot neck 86 within enclosed spring mounting pockets 130. Each spring mounting pocket 130 can be formed between an arcuate spring retention rib 132 provided on the pivot ring and which is offset from the inner diameter of the pivot ring 88, and a corresponding flange rib 134, which is formed inside the pivot neck 86. The ends of the right coil spring 126 are constrained between a vertical stop rib 136 formed along the center line of the pivot ring 88 and a right stop rib 138 inside the pivot neck 86. Likewise, the ends of the left coil spring 128 are constrained between the vertical stop rib 136 and a left stop rib 140. Any suitable biasing mechanism can be used, and opposed coil springs have been illustrated for exemplary purposes only.

Figure 8:
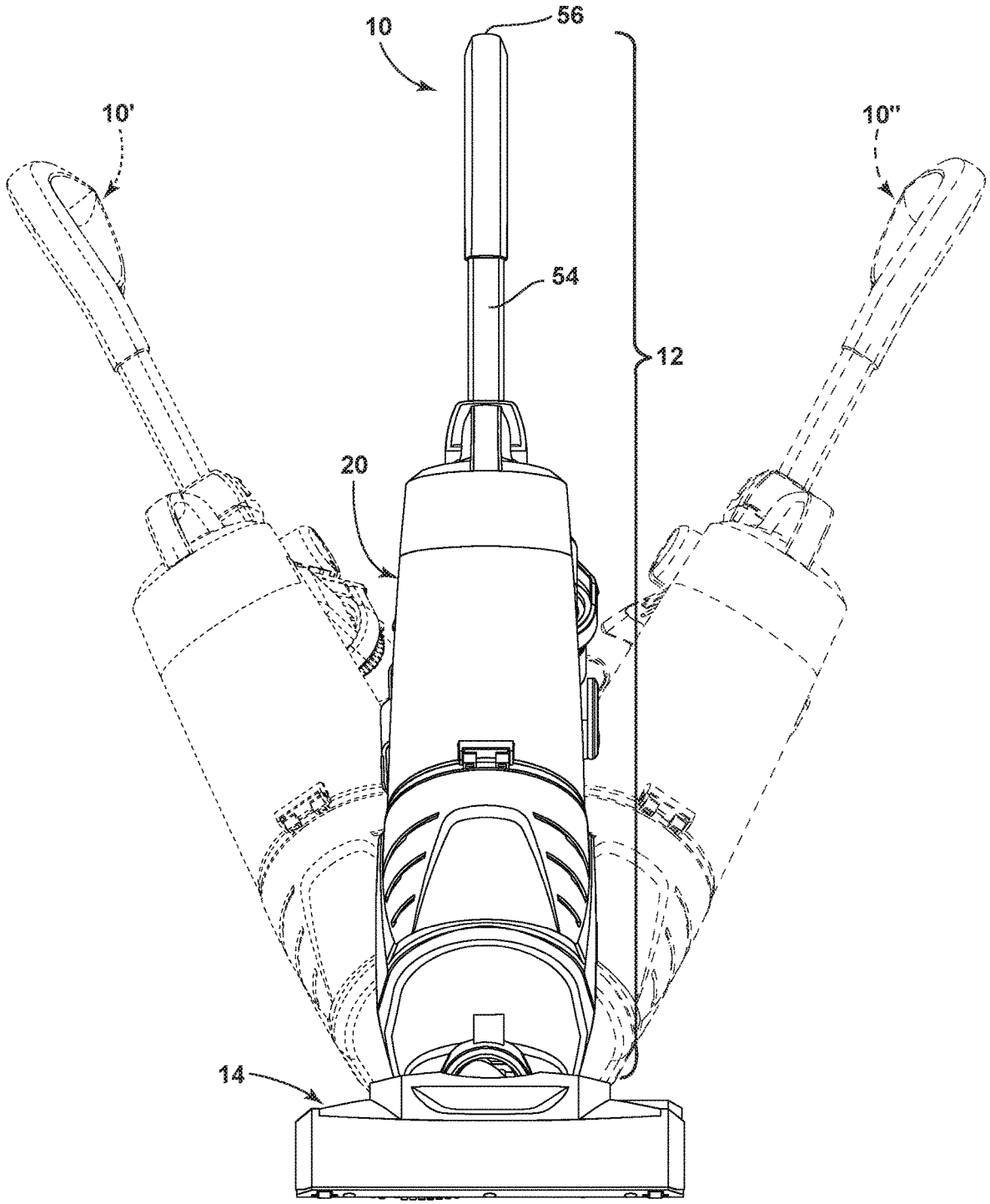
FIG. 8 is a front view of the vacuum cleaner from FIG. 1, showing the handle of the vacuum cleaner in left, right, and neutral positions.
Figure 9:
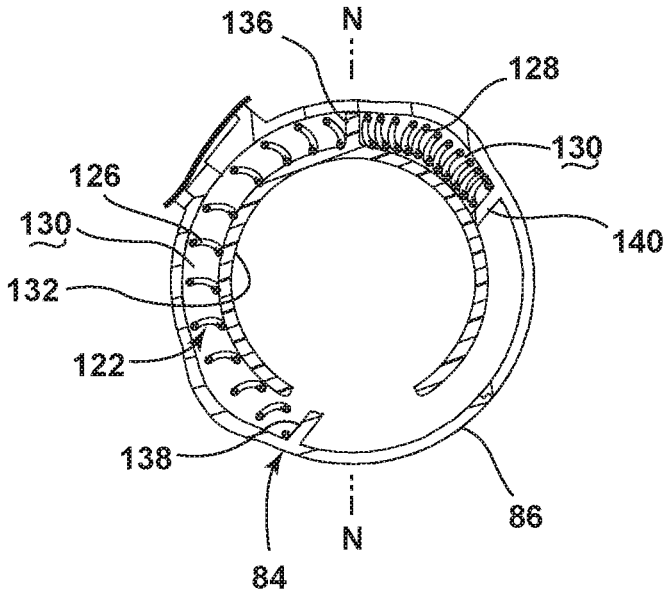
FIG. 9 is a schematic view similar to FIG. 7, showing the multi-axis joint when the handle is in the right position.
Figure 10:
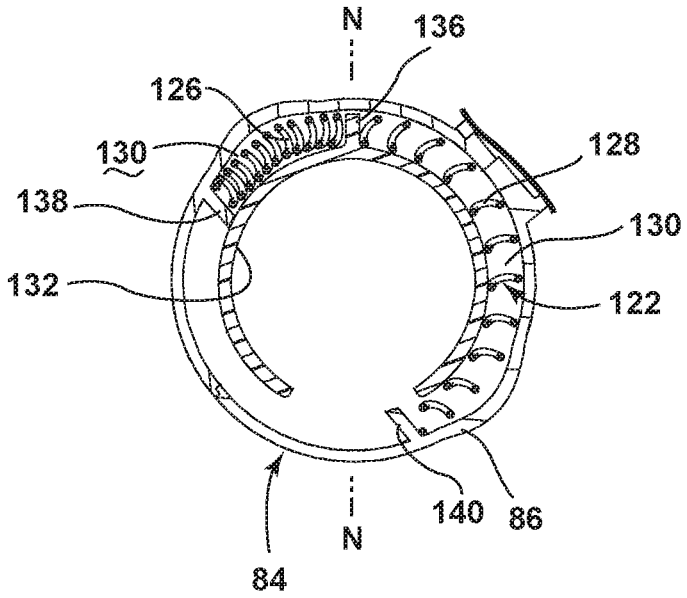
FIG. 10 is a schematic view similar to FIG. 7, showing the multi-axis joint when the handle is in the left position.

Referring to FIGS. 8 and 10, when a user exerts force on the grip 56 to twist the handle 12 to the left (as demonstrated by vacuum 10" in FIG. 8), about the first axis Z, the right stop rib 138 moves counter-clockwise and compresses the right coil spring 126 against the stationary vertical stop rib 136. Conversely, the left stop rib 140 rotates counter-clockwise about the first axis Z, away from the vertical stop rib 136, and thus decreases compression on the left coil spring 128. Thus, the compressed right coil spring 126 exerts an increased outward spring force between the vertical stop rib 136 and the right stop rib 138, which tends to counteract the user-applied force and pushes the right stop rib 138 away from the vertical stop rib 136, which, in turn, rotates the pivot neck 86 and associated handle assembly 12 clockwise towards the neutral position "N." Likewise, referring to FIGS. 8 and 9, the left coil spring 128 functions in the same manner when the handle 12 is rotated to the right (as demonstrated by vacuum 10' in FIG. 8), or clockwise about the first axis Z. As the left coil spring 128 becomes compressed between the stationary vertical stop rib 136 and the left stop rib 140, the left coil spring 128 forces the left stop rib 140 away from the vertical stop rib 136, which rotates the pivot neck 86 and associated handle assembly 12 counter-clockwise towards the neutral position "N."

Accordingly, the biasing mechanism 122 tends to self-center the handle assembly 12 about the first axis Z such that the handle assembly 12 tends to spring back to the neutral position "N." The biasing mechanism 122 can also reduce the force a user must exert to return the handle assembly 12 to the neutral or position so that the opposed right and left coil springs 126, 128 are at equilibrium.

The materials for the pivot ring 88 and pivot neck 86 can comprise plastic injection molded materials, and can preferably be selected from a group of lubricious plastic materials, such as Acetal or Nylon, for example. The lubricious components can reduce friction between mating bearing surfaces, and can thus reduce the force required by a user to rotate the joint 84. In addition, lubricious components can improve the durability of the joint components.

The joint 84 can optionally comprise a lubricant coating that can be applied to the mating bearing surfaces, such as the bearing channel 94 and bearing protrusion 96, to minimize friction and improve durability. In another configuration (not shown), intermediate components such as ball bearings, needle bearings or a bearing or wear strip can be incorporated in the joint 84 in the bearing channel 94 between the pivot neck 86 and pivot ring 88 to reduce friction, for example. The bearing or wear strip can comprise a thin band or strip of material having a low coefficient of friction such as polytetrafluoroethylene (PTFE), for example, which is commercially available under several brand names, including Teflon®.

Referring to FIG. 3, the module housing 32 comprises longitudinal ribs that protrude rearwardly from a rear support section 144 to form adjacent support wings 146 that are configured to straddle the sides of the elongated structural support 16 to stabilize the vacuum module 20 when it is mounted to the upright handle assembly 12.

Referring to FIG. 6, the bottom of the module housing 32 is configured to selectively mate with the top of the module platform 18. A locator protrusion 148 on the top of the module platform 18 is configured to mate with a corresponding elongate recess 150 on the bottom front portion of the module housing 32 to locate and orient the module housing 32 on the module platform 18 for secure mounting to the upright handle assembly 12. The locator protrusion 148 can be rounded or tapered for facile seating of the module housing 32 on the module platform 18, and nesting of the locator protrusion 148 within the recess 150.

Referring to FIG. 4, a lower support 152 at the bottom of the module housing 32 is configured to abut the inner surface of the brace 76 when the vacuum module 20 is mounted to the upright handle assembly 12. The lower portion of the module housing 32 further comprises a vacuum motor/fan cavity 154 that houses the vacuum motor/fan assembly 46. A pre-motor filter housing 156 is formed above the vacuum motor/fan cavity 154 and is in fluid communication with an inlet 160 (FIG. 6) of the vacuum motor/fan assembly 46. The pre-motor filter housing 156 is configured to receive an air permeable pre-motor filter assembly 158. Optionally, a hinged or removable perforated cover (not shown) can be mounted over the top of the pre-motor filter housing 156 to protect the filter assembly therein from damage while still passing working air through the perforations. An annular seal (not shown) can be fitted between the inlet side of the vacuum motor/fan assembly 46 and the pre-motor filter housing 156. A post-motor filter assembly can also be provided, and is illustrated as an exhaust filter 294 and exhaust vents 296 provided with the module housing 32, downstream of the motor/fan assembly 46.

The vacuum module 20 further comprises a removable dirt separator and collection module 40 that is configured to be selectively mounted to the module housing 32. As shown in FIG. 4, the removable dirt separator and collection module 40 comprises an outer housing 172 with a substantially cylindrical side wall 174, an enclosed top 176 and an open bottom 178. A tangential inlet 38 is formed at an upper portion of the side wall 174 for introducing a dirt-laden working airflow into the dirt separator and collection module 40. The tangential inlet 38 is configured to be selectively fluidly connected to the hose outlet conduit 36 and suction hose 34 when the dirt separator and collection module 40 is mounted on the vacuum module 20.

The top of the outer housing 172 is covered by a crown 184 and a cap 186, which are attached to the outer housing 172. The cap 186 further comprises a carry handle 188 formed on an upper portion thereof for lifting and transporting the dirt separator and collection module 40, the vacuum module 20, or the entire vacuum cleaner 10. A module release latch 190 is pivotally mounted on the carry handle 188 and includes a hook (not shown) for selectively retaining the dirt separator and collection module 40 to the vacuum module 20.

The open bottom 178 is selectively enclosed by a dirt release door 192 that is pivotally mounted to a hinge bracket 194 on the side wall 174 of the outer housing 172. The dirt release door 192 comprises exhaust outlet apertures 196 for fluidly connecting the dirt separator and collection module 40 to the downstream motor/fan assembly 46.

The dirt release door 192 is selectively retained in a closed position by a door release latch 198. The door release latch 198 is pivotally mounted to the side wall 174 of the outer housing 172, opposite the hinge bracket 194. As illustrated, the outer housing 172 is preferably shaped so that the side wall 174 tapers outwardly from the top of the housing 172 towards the bottom of the housing 172 so that the open bottom 178 has a larger diameter than the top of the outer housing 172. The larger diameter open bottom 178 relative to the top of the housing allows collected debris to be more easily discharged through the open bottom 178 of the outer housing 172 when the dirt release door 192 is open, and reduces potential for debris clogs while emptying the module 40.

Figure 11:
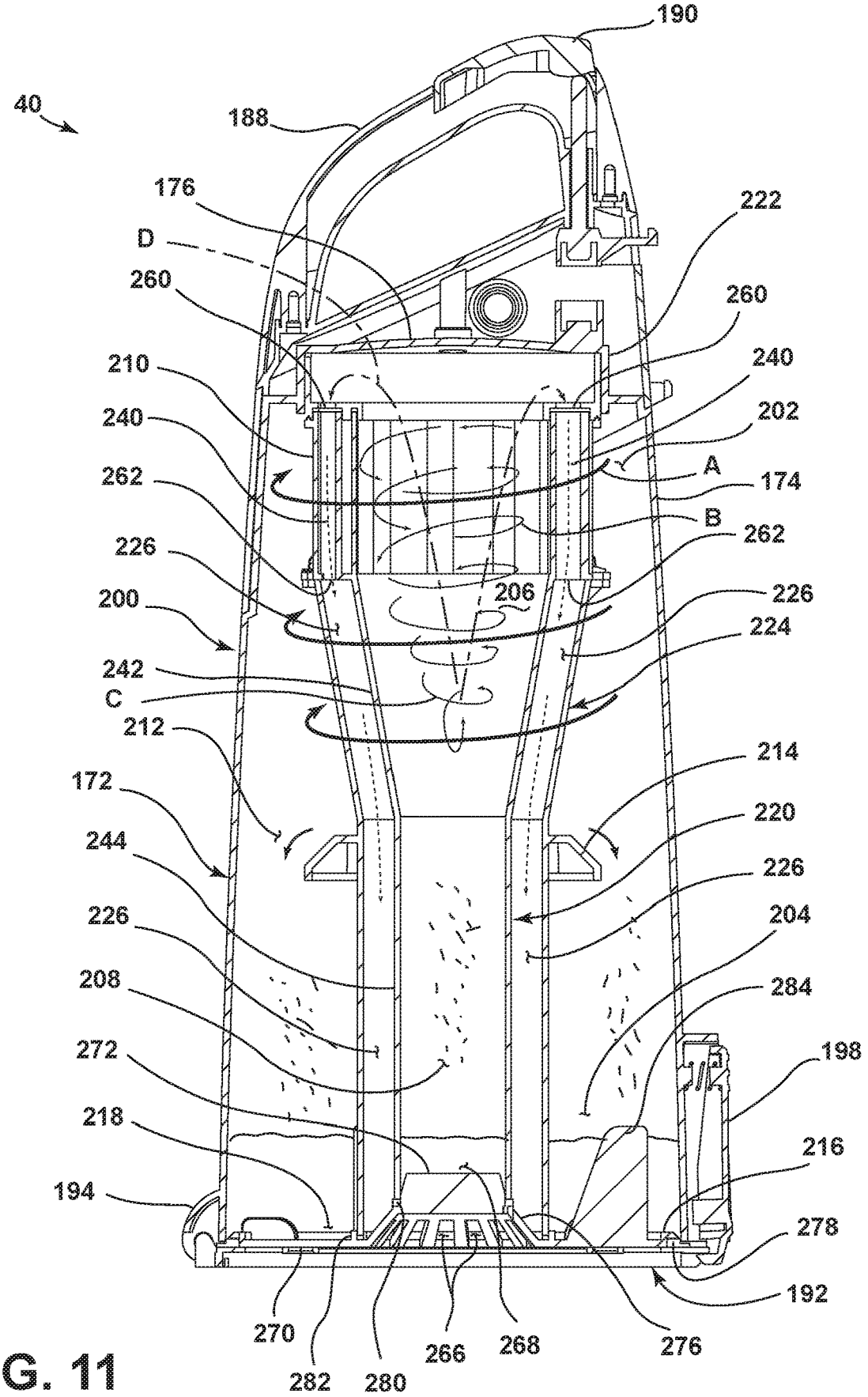
FIG. 11 is a cross-sectional view of a dirt collection and separator module of the vacuum cleaner of FIG. 1, taken along line XI-XI of FIG. 1.

Referring now to FIG. 11, the dirt separator and collection module 40 comprises a two-stage separator assembly 200 further comprising a first stage separation chamber 202, a first stage collection chamber 204, a second stage separation chamber 206 and a second stage collection chamber 208. The first stage separation chamber 202 is formed between an exhaust or separator grill 210 and the sidewall 174 of the outer housing 172. A first stage debris outlet 212 is formed by a gap between a lower separator plate 214 and the sidewall 174.

The first stage collection chamber 204 is formed between an outer separator housing 224 and the sidewall 174, and a bottom wall 216, which is formed by an outer portion of the dirt release door 192. The dirt release door 192 sealingly mates to a first stage collector outlet opening 218 at the bottom of the first stage collection chamber 204. The dirt release door 192 can be selectively pivoted away from the open bottom 178 about the hinge bracket 194 for simultaneously emptying debris stored in the first stage collection chamber 204 and the second stage collection chamber 208.

The separator grill 210 is formed integrally with an inner separator housing 220, which is connected to the bottom of the grill 210 and is in fluid communication therewith. The top of the separator grill 210 is affixed to an upper separator plate 222, which is detachably secured inside the top 176 of the outer housing 172. The inner separator housing 220 comprises an upper frusto-conical separator portion 242, which defines the second stage separation chamber 206, and a lower debris collector portion 244, which defines the secondary collection chamber 208. The debris collector portion 244 comprises a cylindrical tube at a lower portion of the frusto-conical separator portion 242. The outer separator housing 224 abuts the bottom of the separator grill 210 and surrounds the inner separator housing 220 concentrically to form a working air exhaust channel 226 therebetween.

Figure 12:
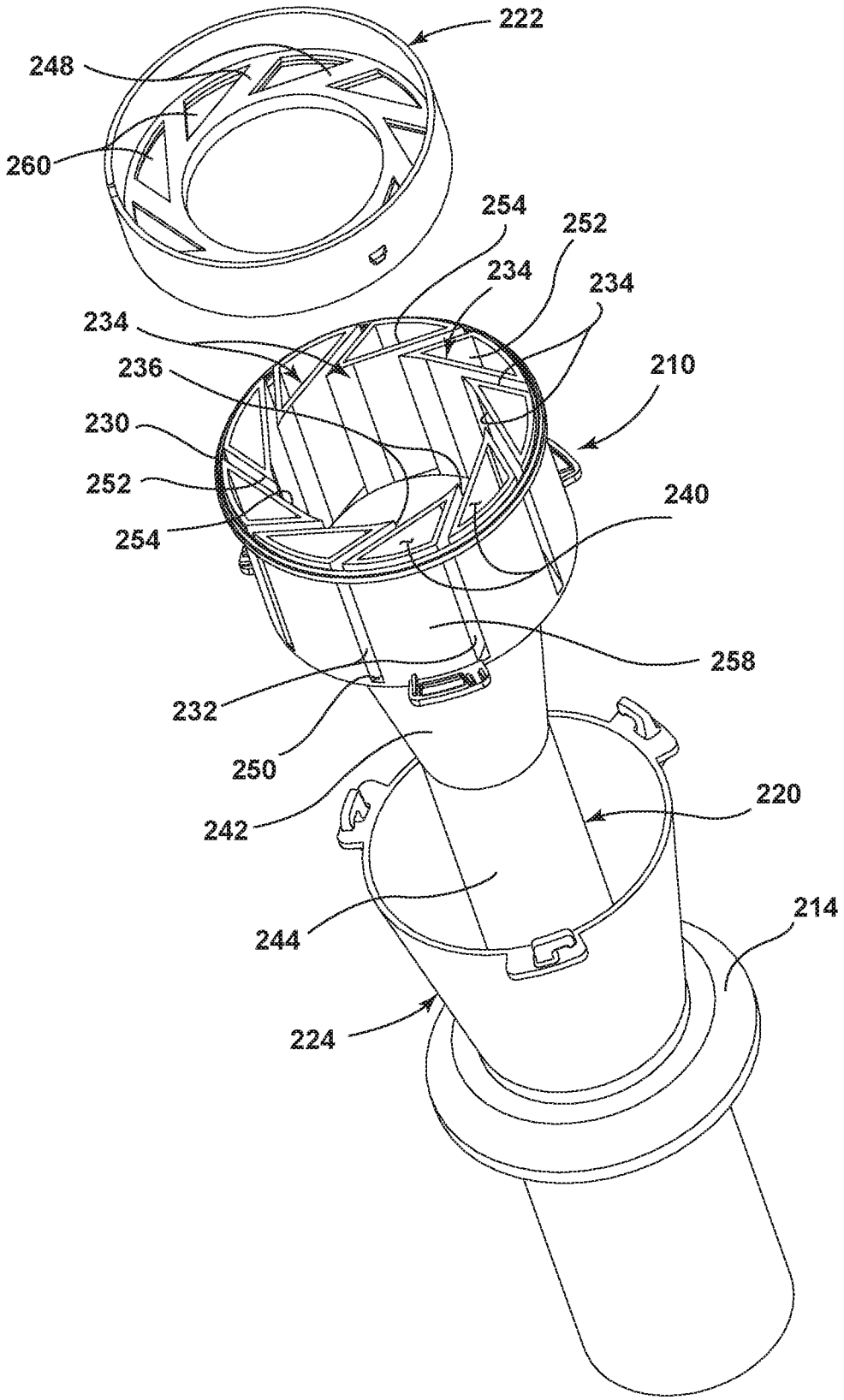
FIG. 12 is an exploded view of a portion of the dirt collection and separator module of FIG. 11.

Referring to FIG. 12, the separator grill 210 comprises a substantially cylindrical body with a cylindrical outer wall 230 that is divided by a plurality of inlet openings 232 formed therein, through which a working airflow may pass. Each inlet opening 232 is defined by a pair of corresponding, adjacent vanes 234 which project radially inwardly from the outer wall 230, along a horizontal axis. Each vane 234 includes a first sidewall 252 and a second sidewall 254, such that the inlet openings 232 are at least partially defined by the first sidewall 252 of one vane 234 and the second sidewall 254 of an adjacent vane 234. The sidewalls 252, 254 defining one of the inlet openings 232 may be substantially parallel to one another. With respect to one vane 234, the length of the second sidewall 254 is shown as being longer than the first sidewall 252 and can preferably be about twice as long as the first sidewall 252.

The inlet openings 232 can be formed as elongated passages within the grill 210, and can be further be defined by a top passage wall 248 which can provided in the upper separator plate 222, and a bottom passage wall 250 provided with the inner separator housing 220. Each inlet opening 232 includes an inlet formed in the outer cylindrical wall 230 and an outlet 236 formed at the terminal ends of the associated adjacent vanes 234.

The grill 210 can further comprise a plurality of exhaust conduits 240. The hollow exhaust conduits 240 can be located around the inner perimeter of the cylindrical wall 230 and oriented along vertical axes. As shown herein, the vanes 234 can be at least partially hollow, such that each vane 234 may define one or more exhaust conduits 240. In the illustrated embodiment, one exhaust conduit 240 is defined per vane 234. Alternatively, each exhaust conduit 240 can be formed between adjacent vanes 234, rather than defined by a vane 234.

Each exhaust conduit 240 can be defined by three interconnected sides; an arcuate section 258 of the outer wall 230, which is formed between successive inlet openings 232, a first sidewall 252 of one of the vanes 234, and a second sidewall 254 of the same vane, both of which are connected to the associated arcuate section 258. Each exhaust conduit 240 can extend downwardly from a corresponding exhaust inlet aperture 260 provided in the upper separator plate 222, and is fluidly connected to an exhaust conduit outlet opening 262 at the bottom of the separator grill 210. The exhaust conduit outlet openings 262 are fluidly connected to the exhaust channel 226 formed between the outer separator housing 224 and the inner separator housing 220. The exhaust channel 226 is fluidly connected to the exhaust outlet apertures 196 formed in the dirt release door 192.

Figure 13:
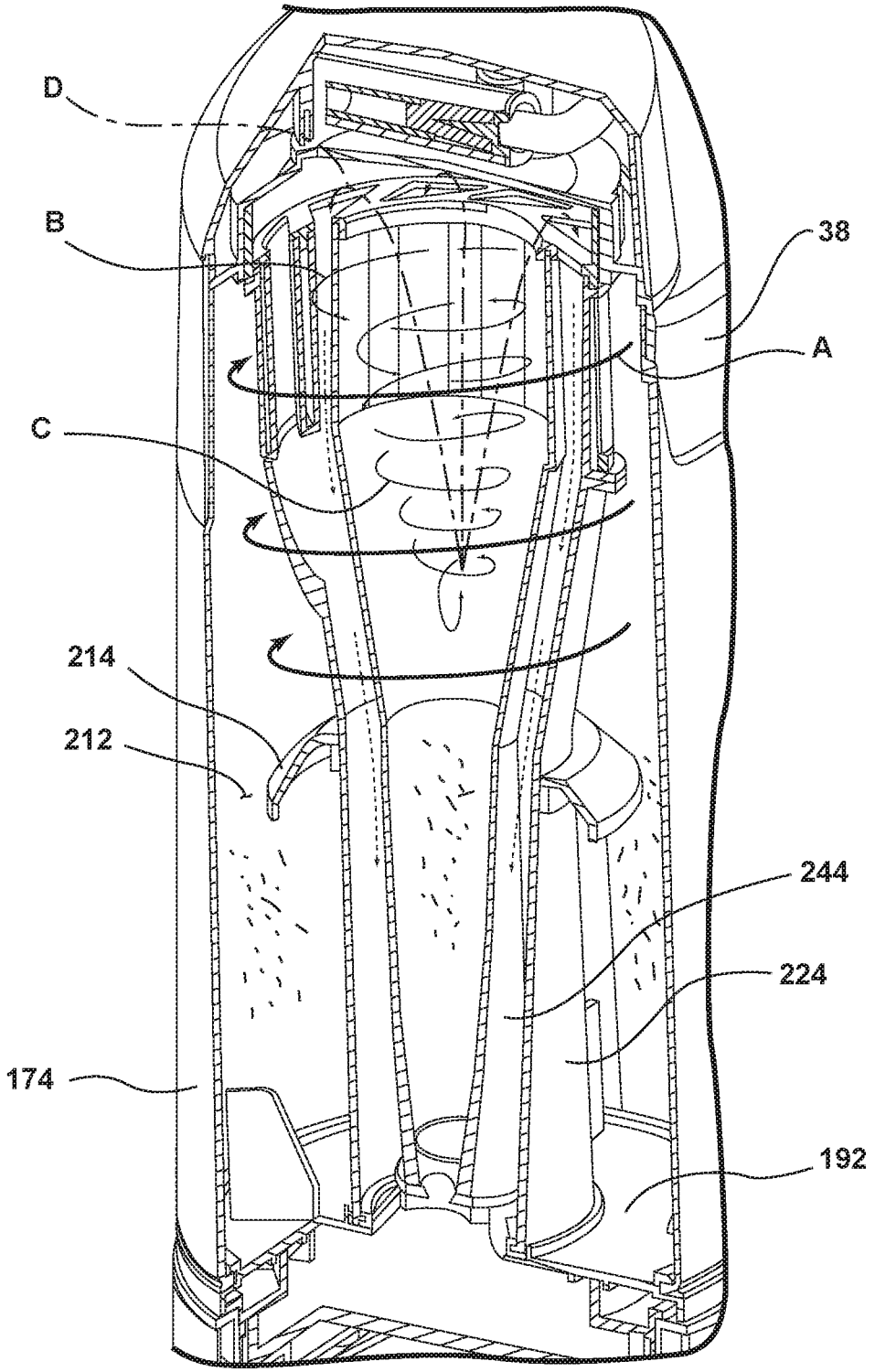
FIG. 13 is a perspective view of the dirt collection and separator module of the vacuum cleaner of FIG. 1, with a portion of the front and side walls cut away for clarity to show the airflow path therein.
Figure 14:
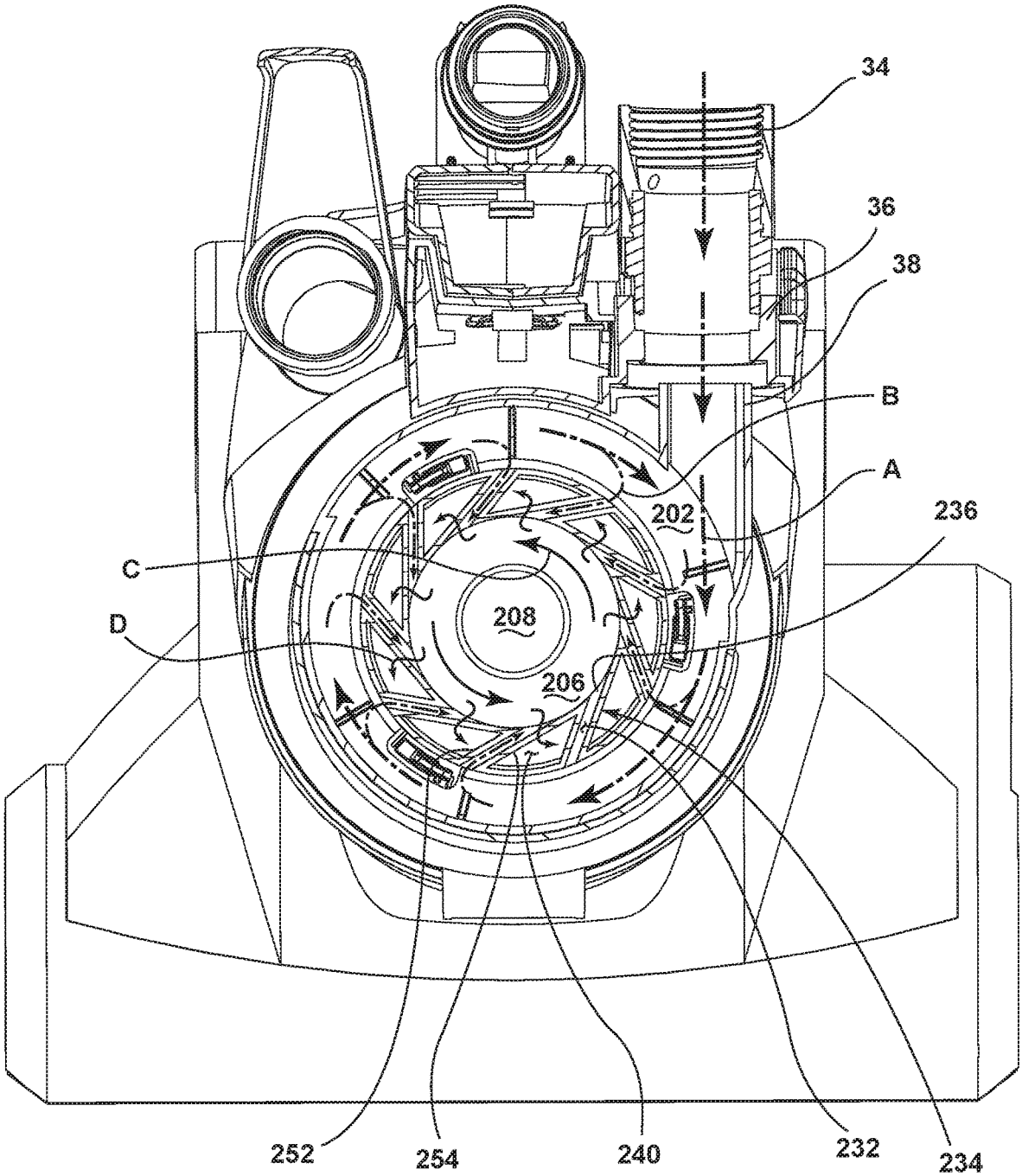
FIG. 14 is a cross-sectional view of the dirt collection and separator module of the vacuum cleaner of FIG. 1, taken along line XIV-XIV of FIG. 1.

A plurality of vanes 234 and exhaust conduits 240 can be located around the inner circumference of the cylindrical outer wall 230. The trajectory of each vane 234, generally indicated by arrow "B", is tangent to the upper frusto-conical separator portion 242 for directing a working airstream into the inner separator housing 220 to separate fine dust and debris therefrom for collection in the debris collector portion 244. As best seen in FIGS. 13 and 14, the separator grill 210 comprises nine vanes 234 and nine corresponding exhaust conduits 240, however the number of vanes 234 and exhaust conduits 240 can vary and the quantity shown in the figures is for exemplary purposes only.

Referring to FIG. 11, the inner separator housing 220 further comprises a second stage debris outlet opening 268 at the bottom of the second stage collection chamber 208 defined by the collector portion 244, which is positioned concentrically within the inner separator housing 220. The bottom of the second stage debris outlet opening 268 sealingly mates to an inner portion of the dirt release door 192 in selective fashion so that the second stage debris outlet opening 268 is isolated from the first stage debris outlet 212.

The dirt release door 192 is movable between a first, closed position, shown in FIG. 11, and second, open position, and can comprise an outer ring-shaped portion 270 that forms the bottom of the first stage collection chamber 204 and an inner circular portion 272 that forms a bottom wall of the second stage collection chamber 208. A plurality of exhaust outlet apertures 266 are formed in the door 192 in an intermediate area 276 between the outer and inner portions 270, 272. When the dirt separator and collection module 40 is mounted to the module housing 32, the exhaust outlet apertures 266 are fluidly connected to the motor/fan inlet 160 for drawing a working airflow through the dirt separator and collection module (see FIG. 3).

The dirt release door 192 can further comprise an outer annular seal 278 configured to seal the bottom perimeter of the outer housing 172. Additionally, the dirt release door 192 can comprise an inner annular seal 280 and intermediate annular seal 282 for sealing the door 192 to the bottom of the inner separator housing 220 and outer separator housing 224, respectively. In the first, closed position, the dirt release door 192 is located adjacent to the bottom of the outer housing side wall 174 and forms the bottom wall of the first and second stage collection chambers 204, 208. The door 192 is configured to selectively pivot away from the outer housing side wall 174, about the hinge bracket 194 when a user depresses the door release latch 198. Vertical fins 284 protrude upwardly from the door 192 into the first stage collection chamber 204 to prevent re-entrainment of debris into the working airflow when the door 192 is sealingly latched to the bottom of outer housing 172, outer separator housing 224 and inner separator housing 220.

The operation of the dirt separator and collection module 40 will now be described with reference to FIGS. 11, 13, and 14 that indicate the working airflow path with arrows "A", "B", "C" and "D." In operation, the vacuum motor/fan assembly 46 is positioned downstream from and fluidly connected to the exhaust outlet apertures 196 in the dirt release door 192. When the vacuum module 20 is mounted to the upright handle assembly 12 and module platform 18, and upon being energized, the vacuum motor/fan assembly 46 draws a working airflow from the suction nozzle inlet opening 22, through the flexible conduit 28 in the foot assembly 14 and hose inlet conduit 44, into the hose inlet 42 and through the suction hose 34 into the tangential inlet 38 of the dirt separator and collection module 40.

The dirt-laden working airflow swirls around the first stage separation chamber 202 in a clockwise direction indicated by arrows "A". Larger debris is separated from the working airflow and falls through the first stage debris outlet 212 and is collected in the first stage collection chamber 204. The vertical fins 284 on the dirt release door 192 help retain the debris in the first stage collection chamber 204 and impede re-entrainment of that debris back into the working airflow.

As indicated by arrows "B", the working airflow must change direction to enter the elongate inlet openings 232 of the separator grill 210. As best seen in FIG. 14, the airflow trajectory "B" through the vanes 234 opposes the first stage flow trajectory "A" so that the angle between flow trajectory "A" and flow trajectory "B" at any given inlet opening 232 forms an acute angle. The working airflow passes through the vanes 234 into the second stage separation chamber 206. The working airflow swirls around the second stage separation chamber 206 in a counter-clockwise direction as indicated by arrows "C" to filter out any remaining debris in the working airflow. The remaining entrained debris is separated from the working airflow and falls into the second stage collection chamber 208.

Next, as indicated by arrows "D", the separated working air flows upwardly and over the top passage walls 248, between the inside top wall of the outer housing 172, and continues to flow downwardly into the exhaust inlet apertures 260. The working air continues to flow downwardly through the exhaust conduits 240 and exits through the exhaust conduit outlet openings 262 at the bottom of the grill 210 into the exhaust channel 226, which is fluidly connected thereto. The exhaust channel 226 is formed in the concentric volume between the outer separator housing 224 and the inner separator housing 220. The working air continues to flow downwardly through the concentric exhaust channel 226 and eventually exits the dirt separator and collection module 40 through the plurality of exhaust outlet apertures 196 in the intermediate ring-shaped area 276 of the.

The working airflow then flows through the pre-motor filter assembly 158 into vacuum motor/fan assembly 46 and is exhausted into the atmosphere through the exhaust filter 294 and exhaust vents 296 in the vacuum motor/fan cavity 154.

The vacuum module 20 can optionally be removed from the upright handle assembly 12 by releasing the vacuum module locking mechanism. A user can depress the button latch 68, which releases the catch 70 from the spine member 52, and then lift the vacuum module 20 away from the spine member 52 and off of the module platform 18. When the vacuum motor/fan assembly 46 is energized, working air is drawn into the hose inlet 42 (or through the suction nozzle inlet opening of various accessory tools 298 when mounted to the hose inlet 42). The function of the dirt separator and collection module 40 is the same regardless of whether the vacuum module 20 is used independently from the upright handle assembly 12 and foot assembly 14 or in conjunction therewith.

To empty debris from the dirt separator and collection module 40, a user first must release the dirt separator and collection module 40 from the vacuum module 20 by depressing the module release latch 190 to release the dirt separator and collection module 40 from the vacuum module 20. Next, the user can depress the dirt door release latch 198 to release the dirt release door 192. The dirt release door 192 pivots downwardly about the hinge bracket 194 under the force of gravity, away from the bottom of the outer housing 172, and exposes the open bottoms of the first stage collection chamber 204 and second stage collection chamber 208. The debris collected in the first and second stage collection chambers 204, 208 falls freely therethrough and can be disposed in a waste receptacle in a facile manner.

Figure 15:
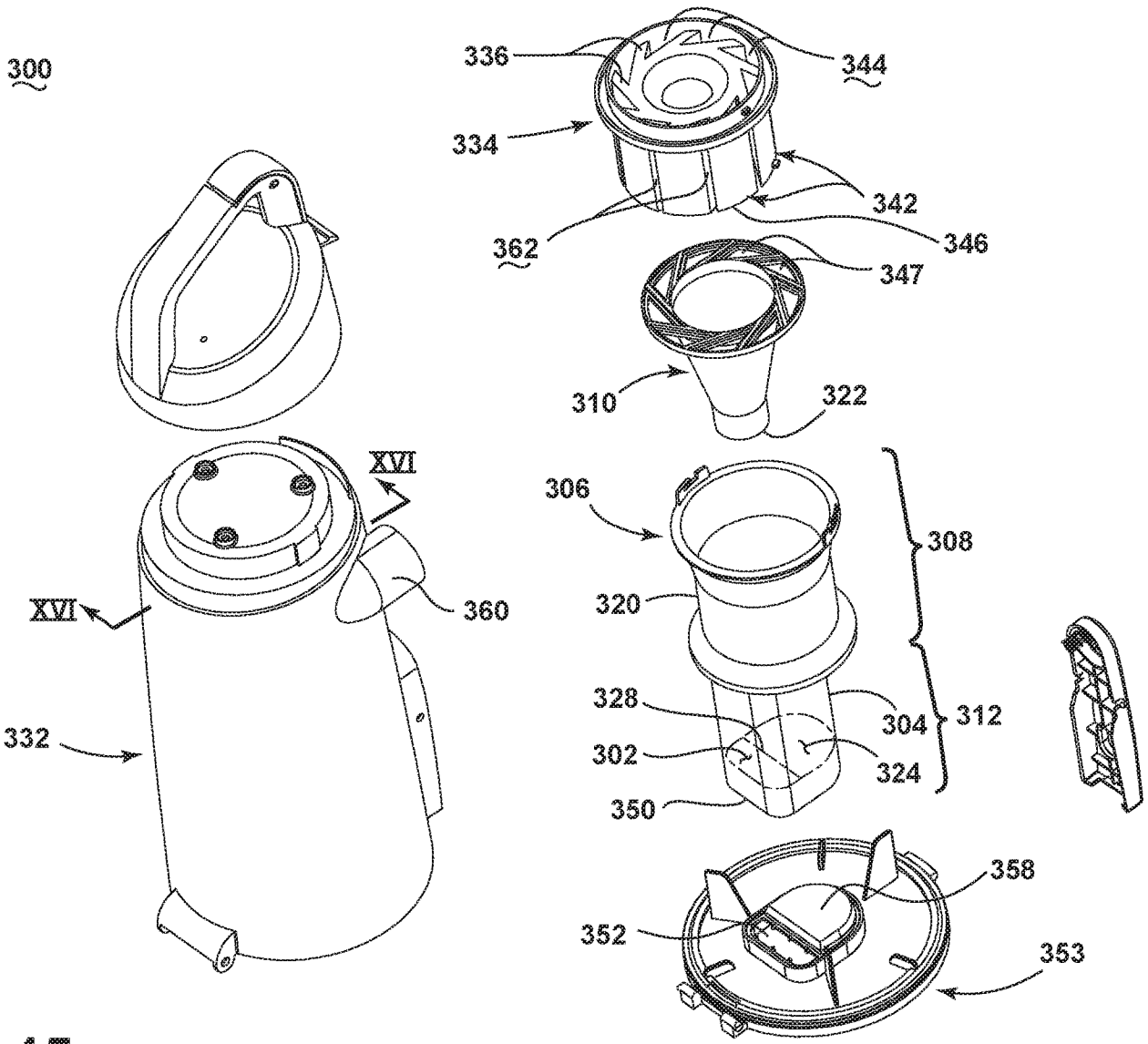
FIG. 15 is an exploded view of a dirt collection and separator module according to a second embodiment of the invention.
Figure 16:
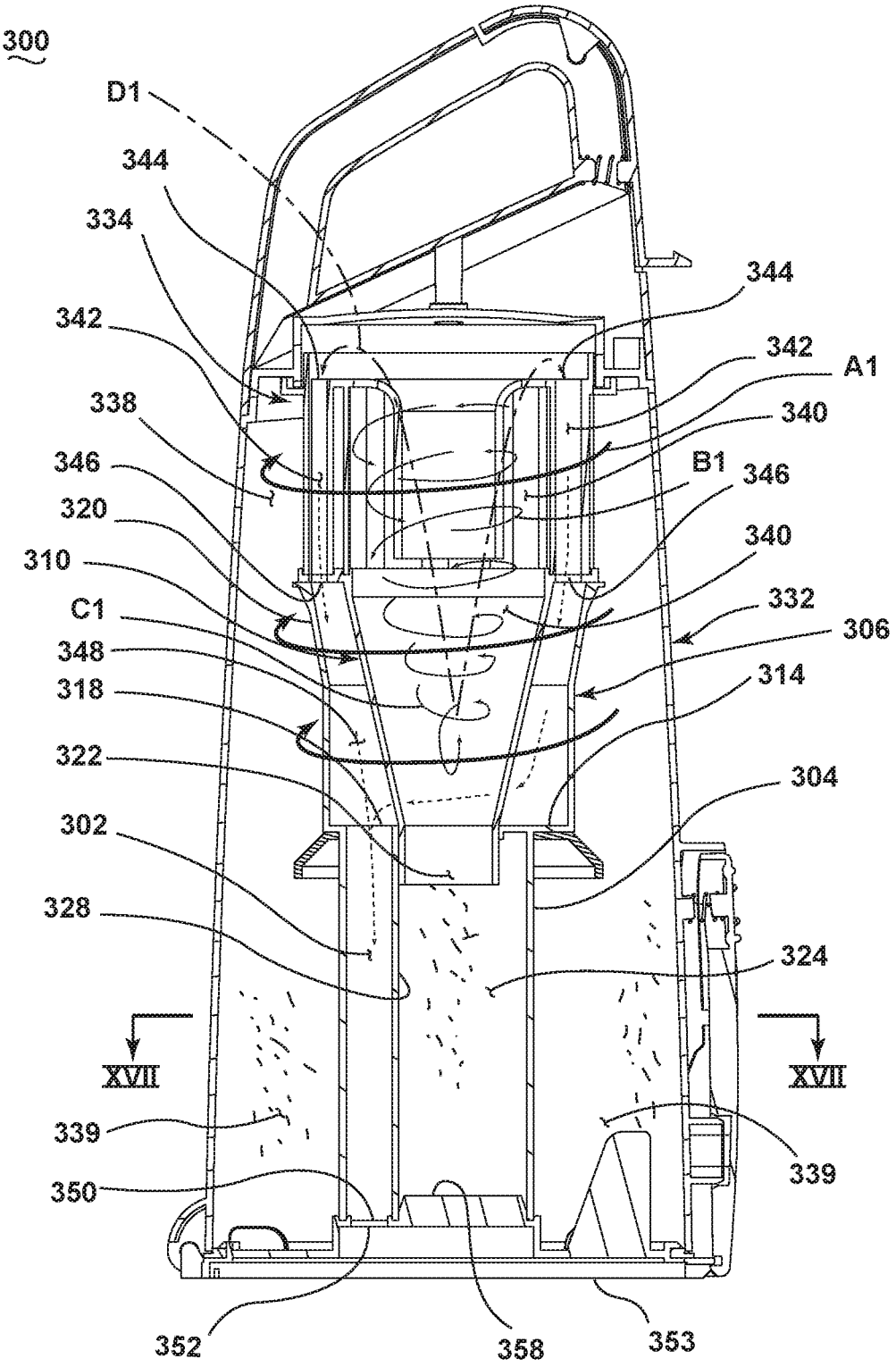
FIG. 16 is a cross-sectional view of the dirt collection and separator module of FIG. 15, taken along line XVI-XVI of FIG. 15.
Figure 17:
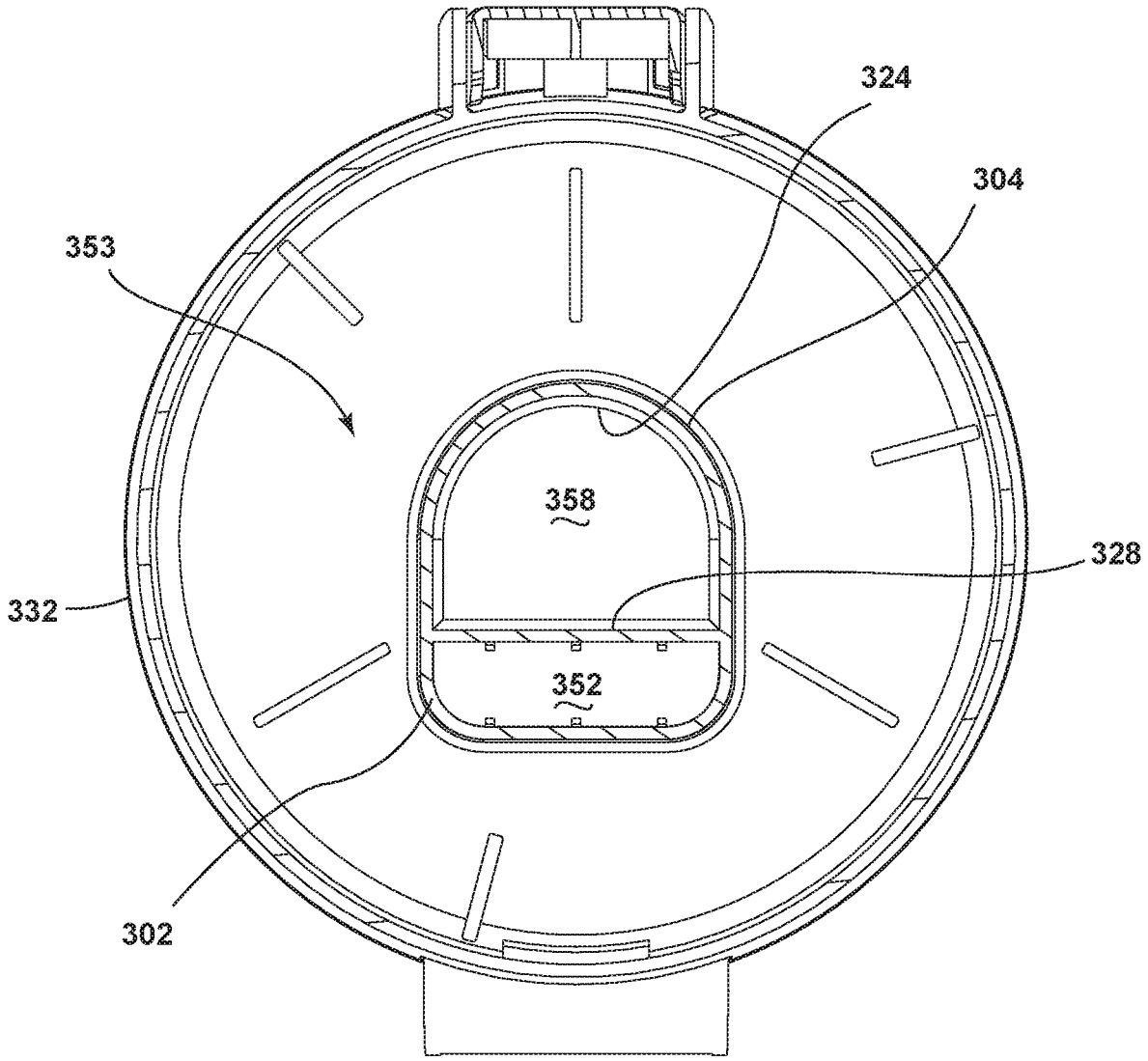
FIG. 17 is a cross-sectional view of the dirt collection and separator module of FIG. 15, taken along line XVII-XVII of FIG. 11.

FIGS. 15-17 illustrate a dirt separator and collection module 300 for a vacuum cleaner according to a second embodiment of the invention. The embodiment illustrated may be similar in some aspects to the previously described embodiment and part numbers being with the 300 series. It may be understood that while like parts may not include like numerals, the descriptions of like parts of the earlier embodiment apply to this embodiment, unless otherwise noted. The dirt separator and collection module 300 is substantially similar to the previous dirt separator and collection module 40, except for the configuration of an exhaust channel 302 and orientation position relative to a second stage debris collection chamber 324. In the second embodiment, the exhaust channel 302 is positioned adjacent to and forwardly of the second stage debris collection chamber 324, instead of concentric to the second stage debris collector as in the previous embodiment. The dirt separator and collection module 300 can be included in place of the module 40 on the vacuum cleaner 10 of the first embodiment.

In the second embodiment, the debris separator and collection module 300 comprises an outer housing 332 that surrounds an outer separator housing 306. The outer separator housing 306 comprises an upper portion 308 that surrounds an inner separator housing 310 and a lower portion 312 that is joined to the upper portion 308 along a horizontal wall 314 (FIG. 16). The upper and lower portions 308, 312 are fluidly connected to each other via an exhaust channel inlet aperture 318 which is formed in the horizontal wall 314. The upper portion 308 comprises a substantially cylindrical sidewall 320 that is configured to surround the inner separator housing 310 so that the cylindrical sidewall 320 is substantially concentric to the outer wall of the inner separator housing 310, which is illustrated in the figures as comprising a frusto-conical shape for exemplary purposes. A debris outlet 322 at the bottom of the inner separator housing 310 is configured to extend through the horizontal wall 314 and open into the lower portion 312 of the outer separator housing 306. The debris outlet is fluidly and sealingly connected to the outer separator housing 306 so that the debris outlet 322 is isolated from the exhaust channel inlet aperture 318.

The lower portion 312 of the outer separator housing 306 comprises a tube 304 defining an exhaust channel 302 and a second stage debris collection chamber 324 located below the debris outlet 322 for collecting debris separated from the working airflow swirling around the inner separator housing 310. The tube 304 is illustrated as comprising a generally "D"-shaped profile for exemplary purposes, and includes an inner partition wall 328 that separates the exhaust channel 302 from the second stage debris collection chamber 324.

Similar to the previous embodiment, the debris separator and collection module 300 further comprises a separator grill 334 mounted below the top wall of the outer housing 332. The separator grill 334 comprises a plurality of inlet passages 336 for directing working airflow inwardly from a first stage separation chamber 338 into a second stage separation chamber 340 within the separator grill 334 and inner separator housing 310, which is mounted to the bottom of the grill 334.

Likewise, as in the previous embodiment, vertical exhaust conduits 342 are formed between the horizontally oriented inlet passages 336 and are configured to guide working air from the second stage separation chamber 340, through exhaust conduit inlets 344 at the top of the grill 334 and downwardly through the associated exhaust conduits 342 located around the perimeter of the grill 334, to corresponding exhaust conduit outlets 346 at the bottom of the grill 334. In the second embodiment, the exhaust conduit outlets 346 are fluidly connected to corresponding exhaust apertures 347 at the top of the inner separator housing 310, which abuts the bottom of the separator grill 334. The exhaust conduit outlets 346 are fluidly connected to a downstream working air exhaust chamber 348, which is defined between the cylindrical sidewall 320 of the outer separator housing 306 and the frusto-conical outer wall of the inner separator housing 310, above the exhaust channel inlet 318.

The exhaust chamber 348 is fluidly connected to the exhaust channel 302 via the exhaust channel inlet aperture 318. The exhaust channel 302 further comprises an exhaust channel outlet 350 at the bottom thereof. The exhaust channel outlet 350 is fluidly connected to an exhaust aperture 352 in the dirt release door 353. A seal 354 can be fitted between the exhaust channel outlet 350 and the exhaust aperture 352 for minimizing leakage when the door is in a closed position. The exhaust aperture 352 is further configured to be fluidly connected to the motor/fan assembly 46 as described in the previous embodiment.

A D-shaped, raised portion 358 on the dirt release door 353 defines the bottom of the second stage collector chamber 324, and is configured to selectively close the bottom of the second stage collection chamber 324 when the door 353 is in the closed position, as shown in FIG. 16.

As best seen in FIG. 16, the second stage debris collection chamber 324 is positioned rearwardly and adjacent to the rectangular exhaust channel 302. This orientation can accommodate a relatively larger second stage collection chamber 324, as illustrated herein, as compared to the previous embodiment of the debris collector portion 244 (FIG. 11). The larger collection volume of the second stage collection chamber 324 can enhance performance by reducing the potential for fine debris within the tube 304 from becoming re-entrained in the working airflow during use. During use, when the upper handle assembly 12 is in a reclined position, the debris collected in the tube 304 has a tendency to accumulate towards the back of the tube 304 due to the handle orientation. The increased volume of the second stage collection chamber 324 prolongs the time required for the fine debris stored therein to accumulate and gradually rise up the walls of the tube 304 towards the debris outlet 322, compared to a collector having a smaller volume. Accordingly, the larger volume reduces potential for re-entrainment of debris contained within the tube 304.

In operation, the dirt separator and collection module 300 can be fluidly connected to the motor/fan assembly 46 so that the exhaust aperture 352 in the dirt release door 353 is fluidly connected to the inlet 160 of the motor/fan assembly 46. Upon energizing the motor/fan assembly 46, a working airflow is drawn through the upstream working air path and hose assembly as previously described and into a tangential inlet 360 of the dirt separator and collection module 300. The dirt-laden working air swirls around the first stage separation chamber 338 in a clockwise direction indicated by arrows "A1" (FIG. 16). Larger debris is separated from the working airflow and is collected in a first stage collection chamber 339.

The working airflow then changes direction and enters inlet openings 362 of the separator grill 334 and passes through the inlet passages 336 into the second stage separator chamber 340 as indicated by arrows "B1". Then, the working airflow swirls around the second stage separation chamber 340 in a counter-clockwise direction as indicated by arrows "C1" to filter out any remaining debris in the working airflow. The remaining entrained debris is separated from the working airflow and falls into the second stage collection chamber 324, within the tube 304.

Next, as indicated by arrows "Dl", the separated working air flows upwardly and over the top vane walls of the inlet passages 336, between the inside top wall of the outer housing 332, and continues to flow downwardly into the exhaust conduit inlets 344. The working air continues to flow downwardly through the exhaust conduits 342 and exits through the exhaust conduit outlets 346 at the bottom of the grill 334 into the exhaust chamber 348, which guides the working air through the exhaust channel inlet aperture 318. The working air continues to flow downwardly through the exhaust channel 302, which is positioned in front of the second stage debris collection chamber 324 and through the exhaust channel outlet 350. The working air exits the dirt separator and collection module 300 through the aligned exhaust aperture 352 in the dirt release door 353 and continues on through the downstream pre-motor filter 158 and motor/fan assembly 46, whereupon it is exhausted into the atmosphere through an exhaust filter 294 and exhaust vents 296 in the vacuum motor/fan cavity.

In the configuration illustrated herein, the separator and collection module 40, 300 includes a separation portion having multiple separation stages for separating contaminants from a working airstream and an integral dirt collection portion for receiving and collecting the separated contaminants from the separation portion. In another configuration, the module 40, 300 can have a single separation stage. Alternatively, a separate stage of the module 40, 300 can have multiple, parallel separation chambers. With respect to any of these configurations of the separation portion, the dirt collection portion can be integral with the separation portion, or can be formed as a removable dirt cup.

While the invention has been specifically described in connection with certain specific embodiments thereof, it is to be understood that this is by way of illustration and not of limitation, and the scope of the appended claims should be construed as broadly as the prior art will permit.

What is claimed is:

1. An upright vacuum cleaner, comprising:

an upright handle assembly comprising an elongated structural support having a handle grip at an upper end thereof and a module platform having an upper surface extending forwardly from the elongated structural support, the upper surface having an electrical connector and an air interface;

a foot assembly adapted to be moved along a surface to be cleaned and having a suction nozzle;

a multi-axis joint swivelably mounting a lower portion of the module platform of the upright handle assembly to an upper portion of the foot assembly and defining a first axis about which the upright handle assembly twists relative to the foot assembly and a second axis about which the upright handle assembly pivots relative to the foot assembly, wherein the multi-axis joint comprises:

a pivot neck operably coupled to the upright handle assembly and having an annular bearing channel including upper and lower projections;

a pivot ring defining an outer surface and having an annular bearing protrusion on the outer surface, the pivot ring coupled with the foot assembly and rotatably mounted to the pivot neck such that the annular bearing protrusion is rotatably received by the annular bearing channel and the upper and lower projections restricts axial movement of the pivot ring along the first axis and permit rotation about the first axis;

a biasing mechanism provided within the multi-axis joint and operable to bias the upright handle assembly about the first axis towards a neutral position centered along a vertical plane through the multi-axis joint; and a detachable vacuum module, comprising:

a module housing having a rear side selectively supported by the elongated structural support and a lowermost portion simultaneously supported by the upper surface of the module platform;

a working air path through the module housing and having an air inlet and an air outlet;

a dirt separator carried by the module housing and defining a portion of the working air path and comprising a separator inlet in fluid communication with the air inlet; and a motor/fan assembly carried by the module housing, fluidly upstream of the air outlet, and defining a portion of the working air path;

wherein the detachable vacuum module is adapted to be operated independently from the upright handle assembly and the foot assembly, or mounted on the upper surface and operably coupled to the electrical connector such that the detachable vacuum module is operated in conjunction with the upright handle assembly and foot assembly including providing power via the electrical connector to at least one electrical component of the foot assembly and forming a portion of a working air path from the suction nozzle, through the multi-axis joint and the air interface, to the air inlet.

2. The upright vacuum cleaner of claim 1 and further comprising a removable dirt separator and collection module that is configured to be selectively mounted to the module housing, wherein the dirt separator and collection module comprises the dirt separator.

3. The upright vacuum cleaner of claim 1 wherein the dirt separator comprises a cyclonic dirt separator.

4. The upright vacuum cleaner of claim 1 wherein the elongated structural support is defined by a hollow tubular spine member and a telescoping handle tube slidably received by the hollow tubular spine member, and wherein the handle grip is provided at an upper end of the telescoping handle tube.

5. The upright vacuum cleaner of claim 1, further comprising a flexible suction hose carried by the module housing, the flexible suction hose having a first end in fluid communication with the air inlet of the working air path and a second end adapted to fluidly couple with the air interface on the module platform when the detachable vacuum module is supported on the upright handle assembly by the module platform.

6. The upright vacuum cleaner of claim 1, wherein the first axis lies at an angle to the surface to be cleaned and the second axis is generally parallel to the surface to be cleaned.

7. The upright vacuum cleaner of claim 1 wherein the pivot neck extends downwardly at an angle from the module platform.

8. The upright vacuum cleaner of claim 7, wherein the pivot ring and the pivot neck together operably form first and second spring mounting pockets, and the biasing mechanism comprises a first coil spring mounted along a first side of the multi-axis joint in the first spring mounting pocket and a second coil spring mounted along a second side of the multi-axis joint in the second spring mounting pocket.

9. The upright vacuum cleaner of claim 8, wherein the first coil spring is constrained between a stop provided on the pivot ring and a first stop provided on the pivot neck, and the second coil spring is constrained between the stop provided on the pivot ring and a second stop provided on the pivot neck.

10. The upright vacuum cleaner of claim 7, wherein the pivot neck comprises a cylindrical portion, a longitudinal central axis of which defines the first axis.

11. The upright vacuum cleaner of claim 10, wherein the pivot ring comprises opposed, coaxial pivot bosses that protrude outwardly and define the second axis, and wherein the foot assembly comprises bearings that receive the pivot bosses.

12. The upright vacuum cleaner of claim 1, wherein, from a perspective of a user behind the upright vacuum cleaner, the biasing mechanism comprises a right coil spring mounted along a right side of the multi-axis joint and a left coil spring mounted along a left side of the multi-axis joint.

13. The upright vacuum cleaner of claim 1, further comprising a locator protrusion on the module platform that configured to mate with a corresponding recess on the lowermost portion of the module housing to locate and orient the module housing on the module platform when the detachable vacuum module is supported on the upright handle assembly by the module platform, and wherein the module housing comprises adjacent support wings that protrude rearwardly and straddle the elongated structural support to stabilize the detachable vacuum module when the detachable vacuum module is supported on the upright handle assembly by the module platform.

14. The upright vacuum cleaner of claim 1 wherein the pivot ring comprises at least one pivot boss protruding outwardly from a rear portion of the pivot ring and wherein the at least one pivot boss defines the second axis.

15. An upright vacuum cleaner, comprising:

an upright handle assembly including an elongated structural support having a handle grip, the upright handle assembly including a module platform having an upper surface and a bottom surface, opposite the upper surface, the upper surface of the module platform extending forwardly from the elongated structural support;

a foot assembly adapted to be moved along a surface to be cleaned and having a suction nozzle;

a multi-axis joint swivelably mounting the bottom surface of the module platform of the upright handle assembly to the foot assembly and defining a first axis about which the upright handle assembly twists relative to the foot assembly and a second axis about which the upright handle assembly pivots relative to the foot assembly, wherein the multi-axis joint comprises:

a biasing mechanism provided within the multi-axis joint and operable to bias the upright handle assembly about the first axis towards a neutral position centered along a vertical plane through the multi-axis joint; and a detachable vacuum module selectively mounted on the upper surface of the module platform of the upright handle assembly, the detachable vacuum module comprising:

a module housing having a lowermost portion that is adapted to be at least partially supported by the upper surface of the module platform and overlying the multi-axis joint;

a working air path through the module housing and having an air inlet and an air outlet;

a dirt separator defining a portion of the working air path and comprising a separator inlet in fluid communication with the air inlet; and a motor/fan assembly fluidly upstream of the air outlet and defining a portion of the working air path;

wherein the detachable vacuum module is adapted to be operated independently from the upright handle assembly and the foot assembly or mounted with the lowermost portion of the module housing resting on the upper surface of the module platform and a rear side of the module housing supported by the elongated structural support and operated in conjunction with the upright handle assembly and foot assembly.

16. The upright vacuum cleaner of claim 15, further comprising an air conduit extending through the multi-axis joint and fluidly communicating the suction nozzle with the air inlet when the detachable vacuum module is supported on the upright handle assembly by the module platform.

17. The upright vacuum cleaner of claim 15, further comprising an air interface on the module platform in fluid communication with the suction nozzle, wherein the air interface is fluidly coupled with the air inlet when the detachable vacuum module is supported on the upright handle assembly by the module platform.

18. The upright vacuum cleaner of claim 15, further comprising a protrusion located at a forward portion of the upper surface of the module platform distal from the elongated structural support configured to mate with a corresponding recess on the module housing.

* * * * *